US012338819B2

(12) United States Patent
Guidry, Jr.

(10) Patent No.: US 12,338,819 B2
(45) Date of Patent: Jun. 24, 2025

(54) PROGRESSING CAVITY DEVICES AND ASSEMBLIES FOR COUPLING MULTIPLE STAGES OF PROGRESSING CAVITY DEVICES

(71) Applicant: National Oilwell Varco, L.P., Houston, TX (US)

(72) Inventor: Michael James Guidry, Jr., Hockley, TX (US)

(73) Assignee: National Oilwell Varco, L.P., Houston, TX (US)

( * ) Notice: Subject to any disclaimer, the term of this patent is extended or adjusted under 35 U.S.C. 154(b) by 122 days.

(21) Appl. No.: 17/438,019

(22) PCT Filed: Mar. 10, 2020

(86) PCT No.: PCT/US2020/021841

§ 371 (c)(1),
(2) Date: Sep. 10, 2021

(87) PCT Pub. No.: WO2020/185749

PCT Pub. Date: Sep. 17, 2020

(65) Prior Publication Data

US 2022/0145882 A1 May 12, 2022

Related U.S. Application Data

(60) Provisional application No. 62/816,680, filed on Mar. 11, 2019.

(51) Int. Cl.
*F04C 2/107* (2006.01)

(52) U.S. Cl.
CPC ..... *F04C 2/107* (2013.01); *F04C 2250/201* (2013.01); *F04C 2250/30* (2013.01)

(58) Field of Classification Search
CPC . F04C 2/107; F04C 2250/201; F04C 2250/30
See application file for complete search history.

(56) References Cited

U.S. PATENT DOCUMENTS 2,733,854 A * 2/1956 Chang ..... F04C 18/1075 418/48
3,139,035 A 6/1964 O'Connor
(Continued)

FOREIGN PATENT DOCUMENTS

WO WO-2007085437 A1 * 8/2007 ..... F04C 15/0019

OTHER PUBLICATIONS

Machine translation of WO-2007085437-A1; Inventor: Groenborg et al.; Title: Eccentric Screw Pump; Published Aug. 2, 2007 (Year: 2007).*

(Continued)

*Primary Examiner* — Mary A Davis
(74) *Attorney, Agent, or Firm* — Conley Rose, P.C.

(57) ABSTRACT

A progressing cavity device includes a stator including a first end, a second end, and an inner surface formed from a metallic material that extends between the first end and the second end, and a rotor rotatably disposed in the stator, the stator including a first end, a second end, and an outer surface formed from a metallic material that extends between the first end and the second end, wherein the outer surface of the rotor contacts the inner surface of the stator, wherein the inner surface of the stator includes a conical taper extending between the first end and the second end, wherein the outer surface of the rotor includes a conical taper extending between the first end and the second end.

8 Claims, 34 Drawing Sheets

(56) References Cited

U.S. PATENT DOCUMENTS

| | | | | |
|---|---|---|---|---|
| 4,730,789 | A * | 3/1988 | Geiger | B02C 17/16 241/171 |
| 5,254,893 | A * | 10/1993 | Ide | F16C 33/723 310/90 |
| 6,338,388 | B1 * | 1/2002 | Winkler | E21B 43/126 418/48 |
| 6,358,027 | B1 | 3/2002 | Lane | |
| 6,457,958 | B1 | 10/2002 | Dunn | |
| 8,556,603 | B2 * | 10/2013 | Ree | F04C 13/008 418/48 |
| 9,109,595 | B2 * | 8/2015 | Daunheimer | F04C 2/1071 |
| 9,689,243 | B2 * | 6/2017 | Morrow | E21B 43/126 |
| 9,695,638 | B2 * | 7/2017 | Murray | F04C 2/1071 |
| 11,608,827 | B2 * | 3/2023 | Montie | F04C 2/1073 |
| 2010/0187009 | A1 | 7/2010 | Siher et al. | |
| 2015/0260184 | A1 * | 9/2015 | Farrell | F04C 2/084 29/700 |
| 2015/0354280 | A1 | 12/2015 | Downton et al. | |
| 2019/0145374 | A1 * | 5/2019 | Parhar | F04C 2/1075 418/48 |

OTHER PUBLICATIONS

International Search Report and Written Opinion dated Jun. 25, 2020, for Application No. PCT/US2020/021841.

* cited by examiner

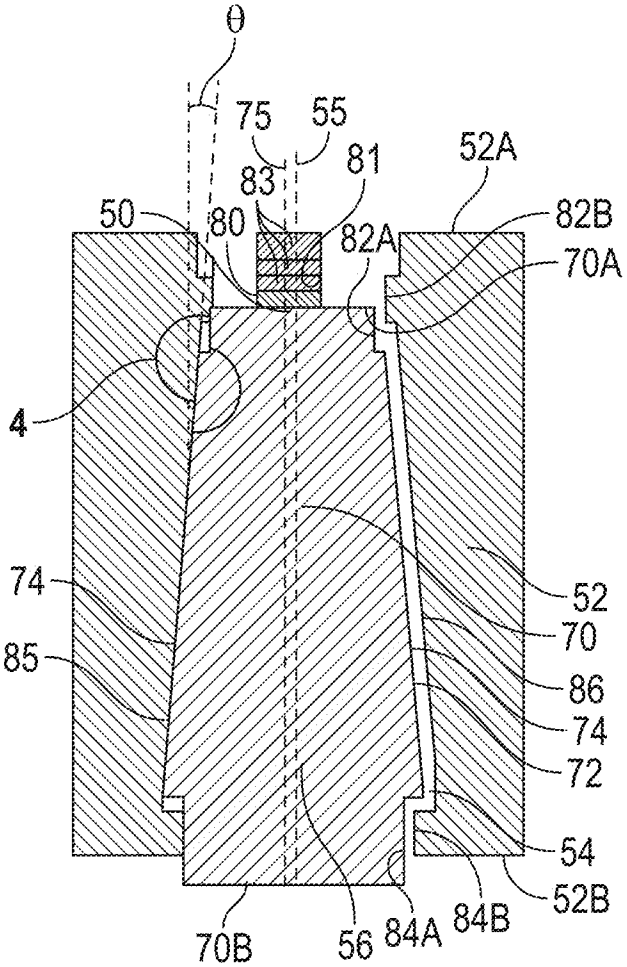
FIG. 3B
FIG. 4
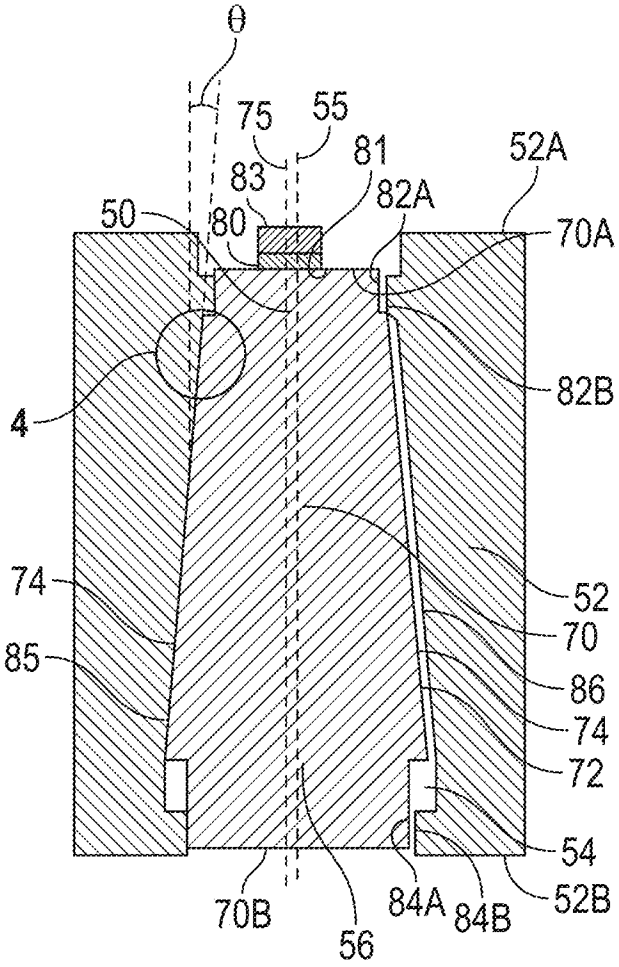
FIG. 3A
FIG. 4

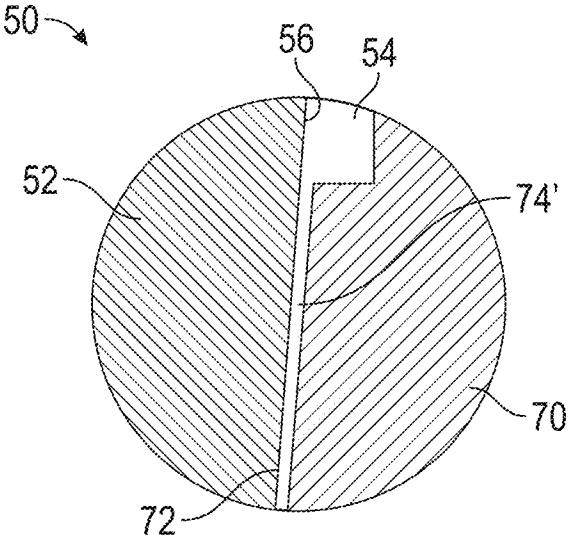
FIG. 6
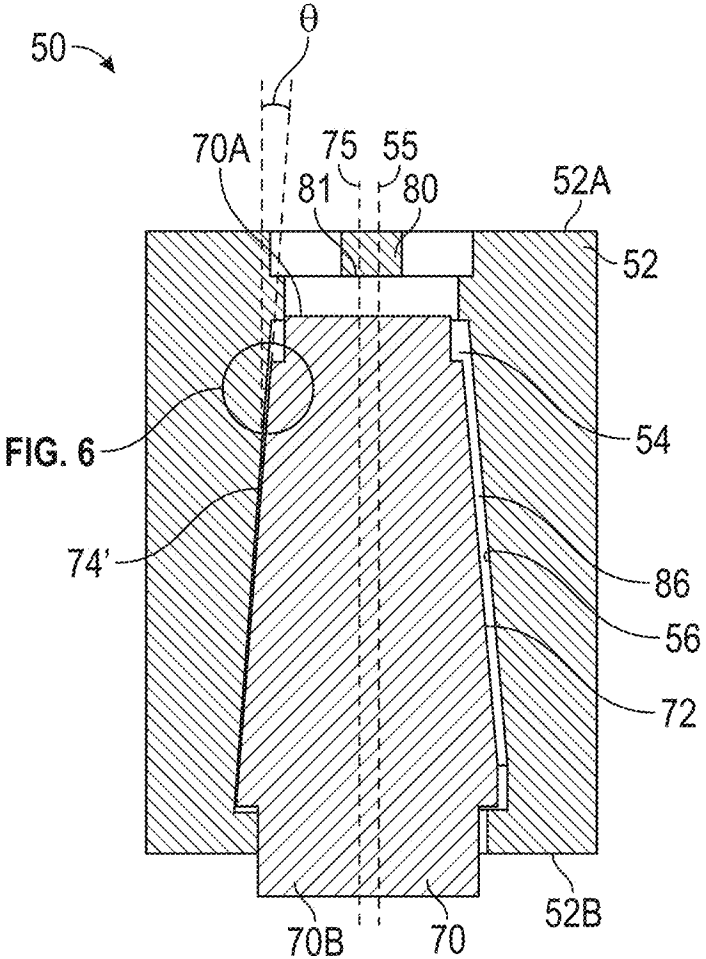
FIG. 6
FIG. 5

PROGRESSING CAVITY DEVICES AND ASSEMBLIES FOR COUPLING MULTIPLE STAGES OF PROGRESSING CAVITY DEVICES

CROSS-REFERENCE TO RELATED APPLICATIONS

This application is a 35 U.S.C. § 371 national stage application of PCT/US2020/021841 filed Mar. 10, 2020, and entitled "Progressing Cavity Devices and Assemblies for Coupling Multiple Stages of Progressing Cavity Devices," which claims benefit of U.S. provisional patent application Ser. No. 62/816,680 filed Mar. 11, 2019, and entitled "Progressing Cavity Devices and Assemblies for Coupling Multiple Stages of Progressing Cavity Devices," both of which are hereby incorporated herein by reference in their entirety.

STATEMENT REGARDING FEDERALLY SPONSORED RESEARCH OR DEVELOPMENT

Not applicable.

BACKGROUND

The present disclosure relates generally to progressing cavity pumps and motors. Still more particularly, the present disclosure relates to assemblies and methods for coupling multiple states of progressing cavity devices together.

A progressing cavity pump (PC pump) transfers fluid by means of a sequence of discrete cavities that move through the pump as a rotor is turned within a stator. The transfer of fluid in this manner results in a volumetric flow rate proportional to the rotational speed of the rotor within the stator. A PC pump also imparts relatively low levels of shear to the fluid, is able to pump multi-phase fluids with a high solids content, and able to pump fluids spanning a broad range in viscosities. Consequently progressing cavity pumps are often used to pump viscous or shear sensitive fluids, such as in downhole operations for the recovery of oil and gas. Progressing cavity pumps may also be referred to as PC pumps, "Moineau" pumps, eccentric screw pumps, or cavity pumps.

A PC pump may be used as a positive displacement motor (PC motor) by applying fluid pressure to one end of the machine to power the rotation of the rotor relative to the stator, thereby converting the hydraulic energy of a high pressure fluid into mechanical energy in the form of speed and torque output. This mechanical energy may be harnessed for a variety of applications, including downhole drilling. Progressing cavity motors may also be referred to as progressing cavity motors (PC motors), positive displacement motors (PC motors), eccentric screw motors, motor power-section, or cavity motors.

Progressing cavity devices (e.g., progressing cavity pumps and motors) include a stator having a helical internal bore and a helical rotor, of the same pitch and one less lead, rotatably disposed within the stator bore. An interference fit between the helical outer surface of the rotor and the helical inner surface of the stator results in a plurality of equally spaced cavities in which fluid can travel. During rotation of the rotor, these cavities advance from one end of the stator towards the other end of the stator. Each of these hollow cavities is isolated and sealed from the other cavities in the ideal case. However the machines are often operated with the clearance fit when it will benefit performance in the particular application.

BRIEF SUMMARY OF THE DISCLOSURE

An embodiment of a progressing cavity device comprises a stator comprising a first end, a second end, and an inner surface formed from a metallic material that extends between the first end and the second end, and a rotor rotatably disposed in the stator, the stator comprising a first end, a second end, and an outer surface formed from a metallic material that extends between the first end and the second end, wherein the outer surface of the rotor contacts the inner surface of the stator, wherein the inner surface of the stator comprises a conical taper extending between the first end and the second end, wherein the outer surface of the rotor comprises a conical taper extending between the first end and the second end. In some embodiments, the taper of the inner surface of the stator and the taper of the outer surface of the rotor each comprise a fixed taper angle. In some embodiments, the outer surface of the rotor is a helical surface comprising a plurality of rotor lobes and the inner surface of the stator is a helical surface comprising a plurality of stator lobes configured to intermesh with the rotor lobes. In certain embodiments, the first end of the stator comprises a fluid inlet end and the second end of the stator comprises a fluid outlet end, and wherein a diameter of the inner surface of the stator is greater at the second end than at the first end of the stator. In certain embodiments, the rotor comprises a first position in the stator providing a first clearance between the outer surface of the rotor and the inner surface of the stator, and the rotor comprises a second position that is axially spaced from the first position and provides a second clearance between the outer surface of the rotor and the inner surface of the stator that is greater than the first clearance.

An embodiment of a downhole assembly comprises a first shaft; a second shaft; a drive connector coupled between the first shaft and the second shaft, wherein the drive connector is configured to permit an axial offset between the first shaft and the second shaft such that a central axis of the first shaft is radially offset from a central axis of the second shaft, and wherein the drive connector is configured to transfer torque between the first shaft and the second shaft. In some embodiments, the drive connector is configured to permit the first shaft to pivot relative to the second shaft about a first axis extending orthogonal to the central axis of the first shaft. In some embodiments, the drive connector is configured to permit the first shaft to pivot relative to the second shaft about a second axis extending orthogonal to the central axis of the first shaft, and wherein the second axis is disposed at a non-zero angle from the first shaft. In certain embodiments, the drive connector is configured to permit the first shaft to pivot relative to the second shaft about the central axis of the first shaft. In certain embodiments, the first shaft comprises a rotor of a progressing cavity pump or power section and the second shaft comprises a drive shaft of a slidable connector module. In some embodiments the downhole assembly further comprises a bearing shaft coupled to the drive shaft of the slidable connector module via an axially slidable connection configured to permit relative axial movement between the bearing shaft and the drive shaft, and wherein the axially slidable connection is configured to permit the transmission of torque between the bearing shaft and the drive shaft, a thrust bearing disposed radially between the bearing shaft and an outer housing of the thrust module. In some embodiments, an end of the bearing shaft of the thrust module comprises a plurality of circumferentially spaced splines that are insertable into a plurality of circumferentially spaced grooves formed in an end of the drive shaft of the slidable connector module. In certain embodiments, the first shaft comprises a first key, the second shaft comprises a second key, the drive connector comprises a body, a first groove formed in the body, and a second groove formed in the body, and the first key is slidably disposed in the first groove and the second key is slidably disposed in the second groove.

An embodiment of a downhole assembly comprises a first shaft comprising a first key, a second shaft comprising a second key, a cylindrical member coupled between the first shaft and the second shaft, wherein the cylindrical member comprises a body, a first groove formed in the body, and a second groove formed in the body, wherein the first key is slidably disposed in the first groove and the second key is slidably disposed in the second groove. In some embodiments, the first key of the first shaft comprises a pair of flanking convex bearing surfaces extending between a root and an end face, and the first groove of the cylindrical member comprises a pair of flanking concave bearing surfaces extending between an upper face and a bottom face, and wherein the bearing surfaces of the first key slidably contact the bearing surfaces of the first groove. In some embodiments, the end face of the first key comprises at least one of a beveled surface and a crowned surface. In certain embodiments, the first key of the first shaft comprises a pair of flanking convex bearing surfaces extending between a root and an end face, and the first groove of the cylindrical member comprises a pair of flanking convex bearing surfaces extending between an upper face and a bottom face, and wherein the bearing surfaces of the first key slidably contact the bearing surfaces of the first groove. In certain embodiments, the first key of the first shaft and the first groove of the cylindrical member each have a rectangular cross-sectional profile. In some embodiments, the first key of the first shaft and the first groove of the cylindrical member each have a rounded dovetail cross-sectional profile. In some embodiments, the first groove of the cylindrical member extends along a first longitudinal axis and the second groove of the cylindrical member extends along a second longitudinal axis that is disposed at a non-zero angle relative to the first longitudinal axis. In certain embodiments, the first key of the first shaft extends between a first longitudinal end and a second longitudinal end, and wherein the first key comprises a pair of flanking convex bearing surfaces extending between a root and an end face of the first key, and each bearing surface of the first key comprises a first tapered surface and a second tapered surface extending between the first longitudinal end and the second longitudinal end of the first key. In some embodiments, the first key of the first shaft extends between a first longitudinal end and a second longitudinal end, and wherein the first key comprises a pair of flanking convex bearing surfaces extending between a root and an end face of the first key, and the end face of the first key comprises a pair of beveled bearing surfaces each comprising a bevel oriented in the direction of a centerline of the first key.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of exemplary embodiments of the invention, reference will now be made to the accompanying drawings in which:

FIG. 3 is a side cross-sectional view of an embodiment of a tapered progressing cavity device in a first position in accordance with principles disclosed herein;

FIG. 5 is a side cross-sectional view of the tapered progressing cavity device of FIG. 3 in a second position;

FIG. 6 is a zoomed-in side cross-sectional view of the tapered progressing cavity device of FIG. 3 in the second position;

DETAILED DESCRIPTION OF EXEMPLARY EMBODIMENTS

Figure 1:
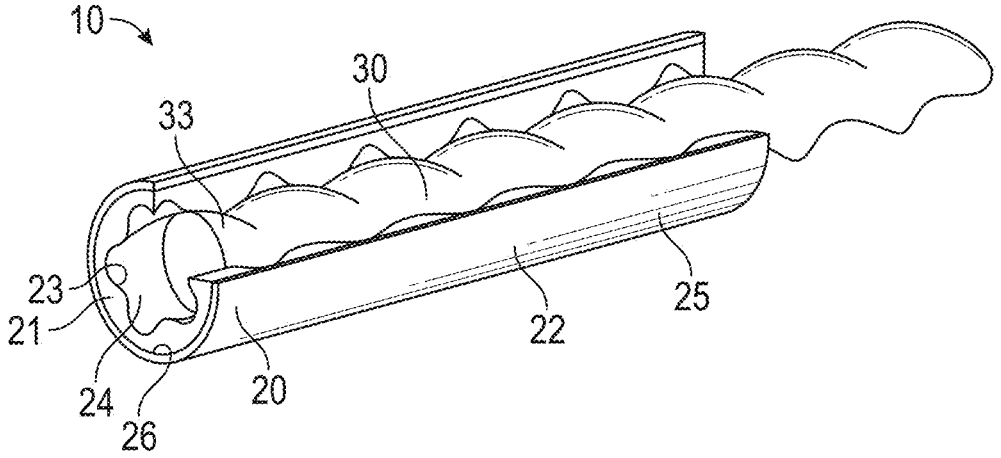
FIG. 1 is a perspective, partial cut-away view of a conventional progressing cavity device.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Figure 2:
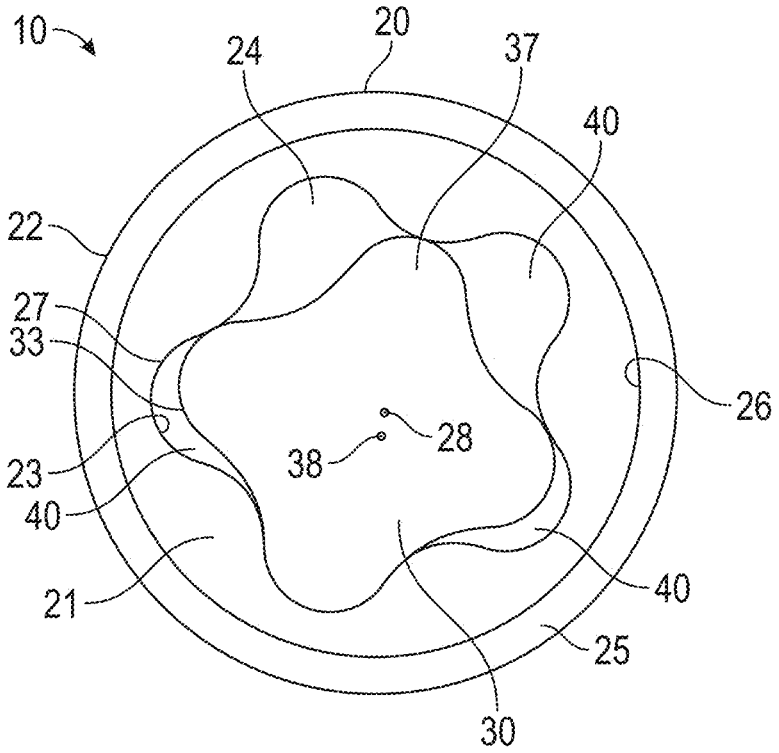
FIG. 2 is an end view of the conventional progressing cavity device of FIG. 1.
Figure 4:
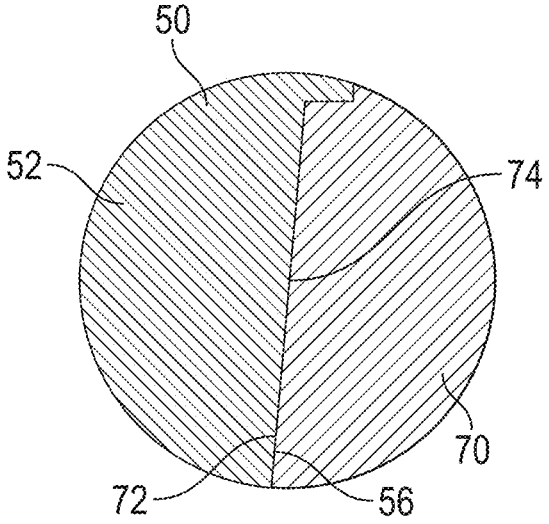
FIG. 4 is a zoomed-in side cross-sectional view of the tapered progressing cavity device of FIG. 3.

Referring now to FIGS. 1 and 2, a conventional progressing cavity (PC) device 10 is shown. In general, PC device 10 may be employed as a progressing cavity pump or a progressing cavity motor. PC device 10 comprises a rotor 30 rotatably disposed within a stator 20. Rotor 30 has a central or longitudinal axis 38 and helical-shaped radially outer surface 33 defining a plurality of circumferentially spaced rotor lobes 37. Rotor 30 is preferably made of steel and may be chrome-plated or otherwise coated for wear and corrosion resistance.

Stator 20 has a central or longitudinal axis 28 and comprises a housing 25 and an elastomeric stator insert 21 coaxially disposed within housing 25. In this embodiment, housing 25 is a tubular (e.g., heat-treated steel tube) having a radially inner cylindrical surface 26, and insert 21 has a radially outer cylindrical surface 22 engaging surface 26. Surfaces 22, 26 are fixed and secured to each other such that insert 21 does not move rotationally or translationally relative to housing 25. For example, surfaces 22, 26 may be bonded together and/or surfaces 22, 26 may include interlocking mechanical features (e.g., surface 22 may include a plurality of radial extensions that positively engage mating recesses in surface 26). Insert 21 includes a helical throughbore 24 defining a radially inner helical surface 23 that faces rotor 30. Although housing 25 and insert 21 have mating inner and outer cylindrical surfaces 26, 22, respectively, in this embodiment, in other embodiments, the stator housing (e.g., housing 25) may have a helical-shaped radially inner surface defined by a helical bore extending axially through the housing, and the elastomeric insert may be a thin, uniform radial thickness elastomeric layer or coating disposed on the helical inner surface of the housing.

Referring still to FIGS. 1 and 2, rotor lobes 37 intermesh with a set of circumferentially spaced stator lobes 27 defined by helical bore 24 in insert 21. As best shown in FIG. 2, the number of lobes 37 formed on rotor 30 is one fewer than the number of lobes 27 on stator 20. When rotor 30 and the stator 20 are assembled, a series of cavities 40 are formed between the helical-shaped outer surface 33 of rotor 30 and the helical-shaped inner surface 23 of stator 20. In this embodiment, each cavity 40 is generally sealed from adjacent cavities 40 by seals formed along the contact lines between rotor 30 and stator 20. The central axis 38 of rotor 30 is parallel to and radially offset from the central axis 28 of stator 20 by a fixed value known as the "eccentricity" of PC device 10.

Generally, the intermeshing stator insert 21 and rotor 30 generate a plurality of cavities 40 separated in the circumferential and longitudinal directions. During operation as a pump rotor 30 of PC device 10 is turned relative to stator 20, thereby driving the axial movement of cavities 40 through device 10 in the direction towards the end with the higher fluid pressure. During operation of PC device 10 as a motor higher pressure fluid is applied to one end of PC device 10. The fluid flow and pressure move the cavities 40 from the end with a high fluid pressure to the end with the lower fluid pressure. The action of applying fluid pressure to the cavities drives the rotation of rotor 30 relative to stator 20.

Referring to FIGS. 3-6, a schematic representation of an embodiment of a tapered PC device 50 is shown schematically in FIGS. 3-6. Tapered PC device 50 may be employed as a progressing cavity pump or a progressing cavity motor. Tapered PC device 50 generally includes a tapered rotor 70 rotatably disposed within a tapered stator 52. Stator 52 of tapered PC device 50 has a central or longitudinal axis 55, a first or inlet end 52A, a second or outlet end 52B, and a throughbore 54 defining a radially inner surface 56 extending between ends 52A, 52B and facing rotor 70 (in the interest of clarity, lobes of stator 52 are not shown in FIGS. 3-6). Stator 52 does not include an elastomeric liner and comprises a nearly rigid, metallic material. In some embodiments, the inner surface 56 of stator 52 may be chrome-plated or coated for wear and corrosion resistance. While in this embodiment stator 52 comprises a metallic material, in other embodiments, stator 52 may comprise nearly rigid nonmetallic materials.

Rotor 70 has a central or longitudinal axis 75, a first or inlet end 70A, a second or outlet end 70B, and a radially outer surface 72 extending between ends 70A, 70B (in the interest of clarity, lobes of rotor 70 are not shown in FIGS. 3-6). Rotor 70 comprises a nearly rigid, metallic material. In some embodiments, the outer surface 72 of rotor 70 may be chrome-plated or coated for wear and corrosion resistance. In this embodiment, tapered PC device 50 includes a thrust bearing 80 positioned at the inlet end 70A of rotor 70 for resisting axially directed loads imparted to rotor 70. In some embodiments, a thrust bearing may also be positioned at the outlet end 70B of rotor 70.

In this embodiment, tapered PC device 50 also includes a plurality of first or inlet radial bearings 82A, 82B and a plurality of second or outlet radial bearings 84A, 84B. Inlet radial bearings 82A, 82B are positioned radially between stator 52 and rotor 70 at the inlet end 70A of rotor 70 while outlet radial bearings 84A, 84B are positioned radially between stator 52 and rotor 70 at the outlet end 70B of rotor 70. Radial bearings 82A, 82B, 84A, and 84B resist radial loads imparted to rotor 70, restrain the eccentric orbit of rotor 70, and minimize wear between the inner surface 56 of stator 52 and the outer surface 72 of rotor 70. Tapered PC device 50 operates in a manner similar to the operation of PC device 10 shown in FIGS. 1, 2, with fluid entering throughbore 54 of stator 52 from inlet end 50A, flowing through cavity 86 formed between the intermeshing stator 52 and rotor 70, and exiting throughbore 54 via the outlet end 50B. In some embodiments, tapered PC device 50 may be operated as a pump, while in other embodiments tapered PC device 50 may be operated as a motor.

Still referring to FIGS. 3-6, the inner surface 56 of stator 52 is conically tapered between inlet end 52A and outlet end 52B, the axis of the cone or conical taper being collinear with central axis 55 of stator 52, and the direction of the taper being such that the diameter of the inner surface 56 of stator 52 at inlet end 52A is less than the diameter of inner surface 56 at outlet end 52B. The taper of the inner surface 56 of stator 52 has a non-zero fixed taper or cone angle θ, and thus, the diameter of inner surface 56 increases linearly from the inlet end 52A of stator 52 to outlet end 52B. Similarly, the outer surface 72 is conically tapered between inlet end 70A and outlet end 70B, the axis of the cone or conical taper being collinear with central axis 75 of rotor 70, and the direction of the taper being such that the diameter of the inlet end 70A of rotor 70 is less than the diameter of outlet end 70B. The taper of outer surface 72 comprises the fixed taper angle θ, and thus, the diameter of the outer surface 72 of rotor 70 increases linearly from the inlet end 70A of rotor 70 to outlet end 70B. Although in this embodiment the inner surface 56 of stator 52 and the outer surface 72 of rotor 70 are tapered along the fixed taper angle θ, in other embodiments, inner surface 56 and/or outer surface 72 may taper along a variable taper angle.

In conventional PC devices employing stators and rotors having nearly rigid (e.g., metallic) enmeshing surfaces, the inner surface of the stator and the outer surface of the rotor are not tapered along their respective axial lengths. In conventional practice, the rotor and stator are threaded together until the rotor and stator begin to bind, at which point the rotor is removed from the stator and the binding point is identified by a contact indicator previously applied to the outer surface of the rotor. The outer surface of the rotor is then buffed at the binding point. In conventional practice, this process is repeated until the full length of the rotor can be threaded into the stator without binding.

By tapering the inner surface 56 of the stator 52 and the outer surface 72 of the rotor 70, as shown in FIGS. 3-6, additional clearance is provided between the enmeshing surfaces 56 and 72 of tapered PC device 50, thereby reducing the buffing required to the outer surface 72 of rotor 70 for fully inserting rotor 70 into stator 52. The reduced buffing to the outer surface 72 of rotor 70 provides a more uniform fit between stator 52 and rotor 70 given that portions of the outer surface 72 of rotor 70 do not need to be buffed to a smaller than desired diameter in order to permit the full insertion of rotor 70 into stator 52.

Additionally, in conventional PC devices, the fit or amount of clearance between the stator and rotor is fixed by the inner diameter of the stator and the outer diameter of the rotor. However, the conical interface formed between the inner surface 56 of stator 52 and the outer surface 72 of the rotor 70 of PC device 50 provides for an adjustable or controllable fit between stator 52 and rotor 70. Particularly, a clearance 85 formed radially between tapered stator 52 and tapered rotor 70 is adjustable by adjusting the axial position of rotor 70 relative to stator 52.

In this embodiment, a radial clearance 74 formed radially between rotor 70 and stator 52 may be adjusted following the manufacture of rotor 70 and stator 52 by adjusting the position of a contact surface 81 of thrust bearing 80. For example, by extending contact surface 81 of thrust bearing 80 towards the outlet end 52B of stator 52, the position of rotor 70 may be adjusted or shifted towards the outlet end 52B of stator 52, thereby increasing the amount of clearance 74 formed between rotor 70 and stator 52. In some embodiments, the position of contact surface 81 may be adjusted by adding or removing bearing shims of thrust bearing 80; however, in other embodiments, the axial shifting of rotor 70 relative to stator 52 may be achieved through other mechanisms.

Conventional PC devices employing nearly rigid (e.g., metallic) enmeshing surfaces are often limited to applications having substantially limited solid content within the fluid of the conventional PC device due to the ability of solids to bind the rigid enmeshing surfaces of the conventional PC device. However, the ability to shift the axial position of rotor 70 relative to stator 52 of tapered PC device 50 permits the flushing of solids or other debris from tapered PC device 50, thereby permitting tapered PC device 50 to be utilized in applications that are not limited to relatively clean fluid having substantially limited solid content.

In this embodiment, rotor 70 of tapered PC device 70 includes a first or operational position in stator 52 (shown in FIGS. 3, 4) and a second or flush-by position in stator 52 (shown in FIGS. 5, 6) that is axially spaced from the operational position in the direction of the outlet end 52B of stator 52. When rotor 70 is in the flush-by position, the operational clearance 74 is increased to provide a flush-by radial clearance 74' formed between the outer surface 72 of rotor 70 and the inner surface 56 of stator 52. Rotor 70 may be actuated between the operational and flush-by positions by applying an axially directed mechanical force (e.g., via a shaft coupled to rotor 70), gravity (e.g., off bottom weight of a bottom hole assembly (BHA)), actuation of an active drive assembly (e.g., powered by an electric submersible motor, etc.), by adjusting the direction of fluid flow through tapered PC device 50, or through other mechanisms. With rotor 70 disposed in the flushed-by position, solids may be flushed from tapered PC device 50 by the flowing of fluid therethrough.

Figure 7:
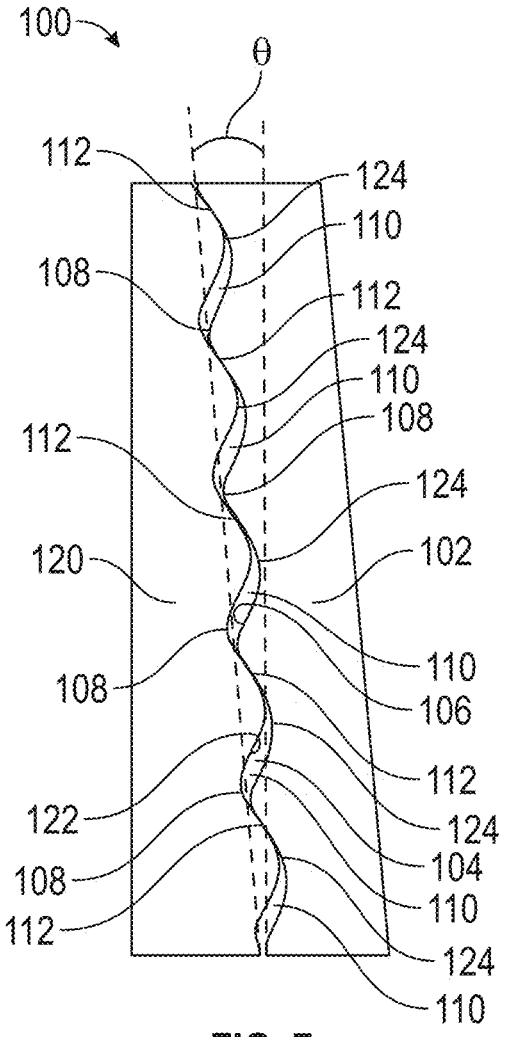
FIG. 7 is a partial, side cross-sectional view of another embodiment of a tapered progressing cavity device in a first position in accordance with principles disclosed herein.
Figure 8:
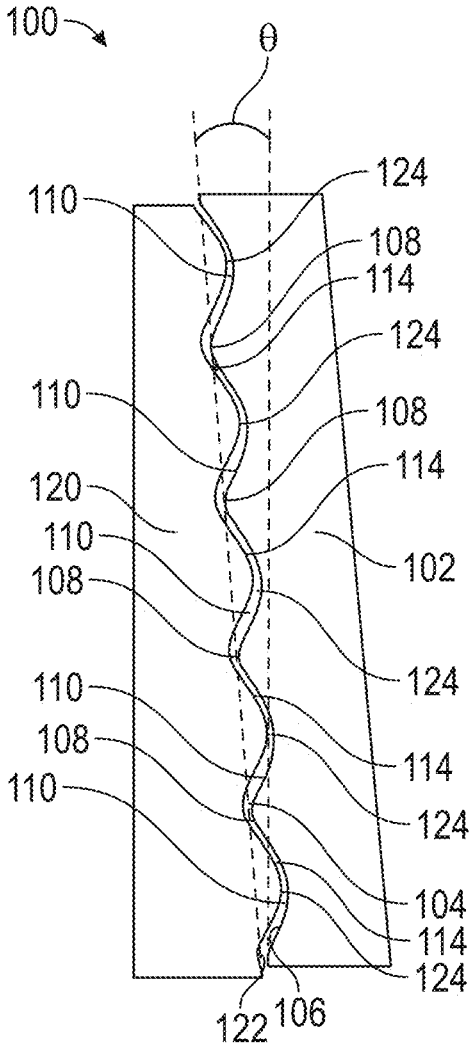
FIG. 8 is a partial, side cross-sectional view of the tapered progressing cavity device of FIG. 7 in a second position.
Figure 9:
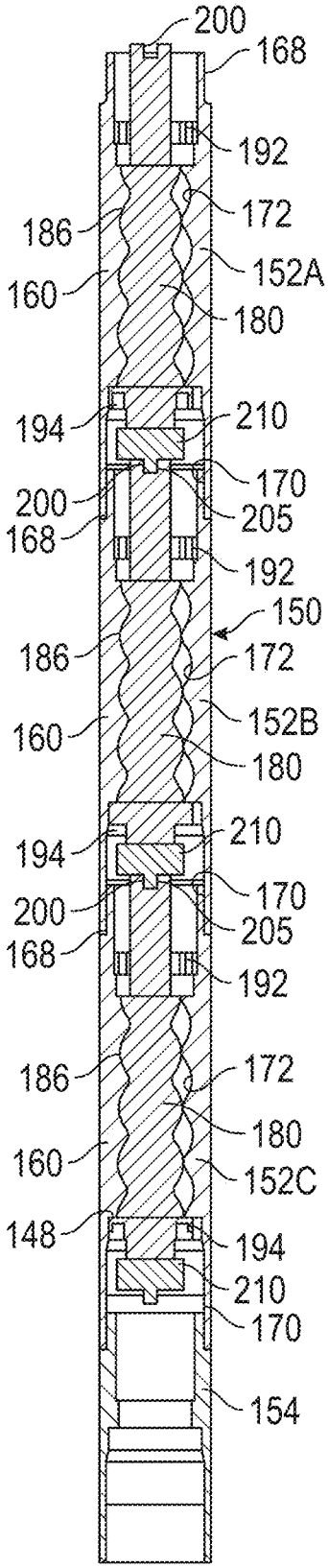
FIG. 9 is a side cross-sectional view of an embodiment of a multi-stage progressing cavity device in accordance with principles disclosed herein.
Figure 10:
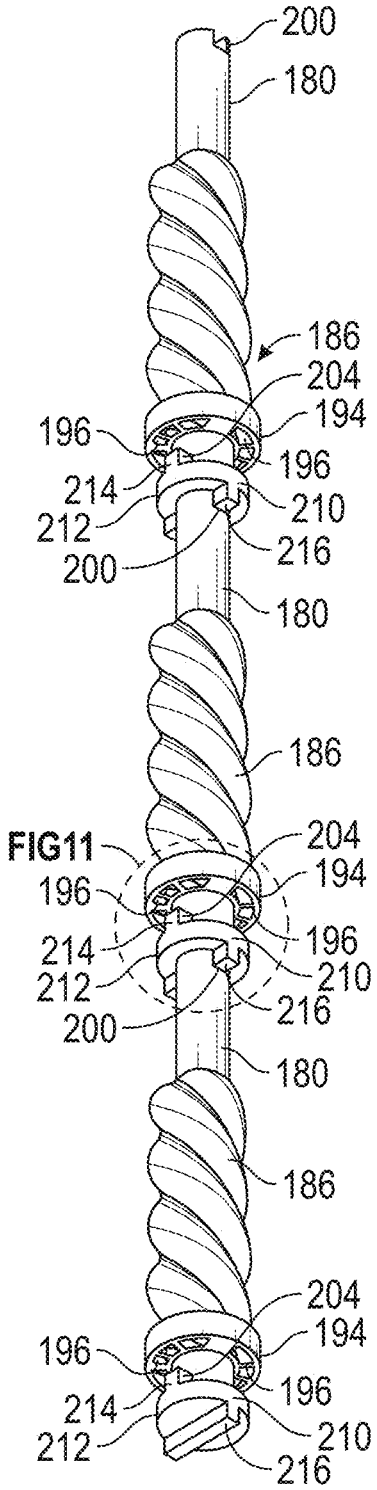
FIG. 10 is a perspective view of a plurality of rotors and slidable drive connectors of the multi-stage progressing cavity device of FIG. 9.
Figure 11:
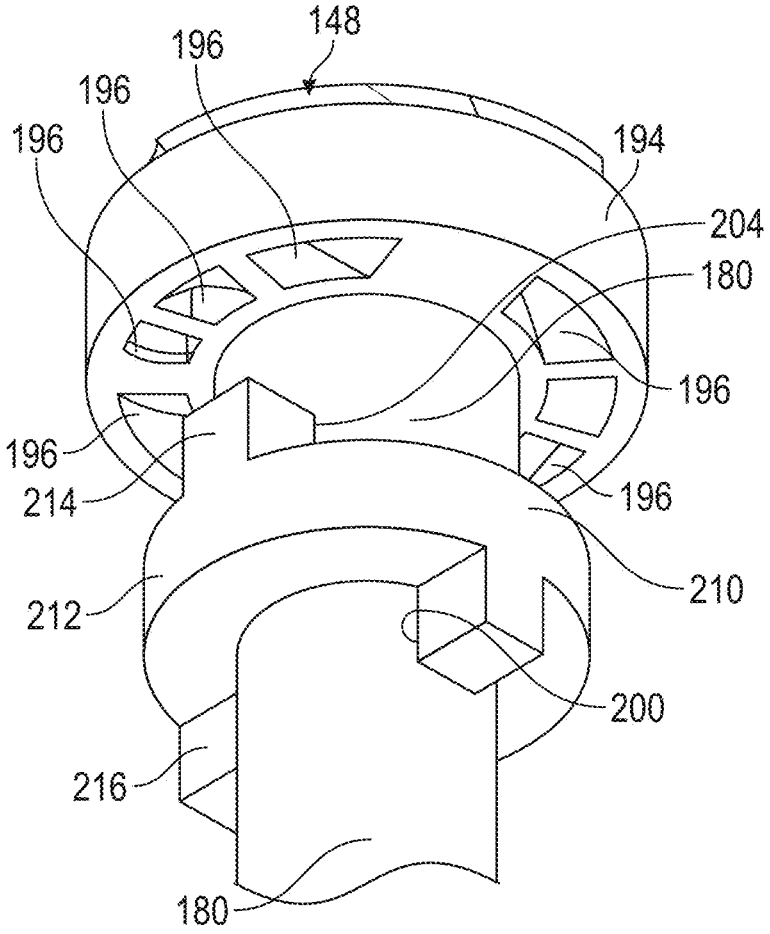
FIG. 11 is a zoomed-in perspective view of the one of the slidable drive connectors of FIG. 10.
Figure 12:
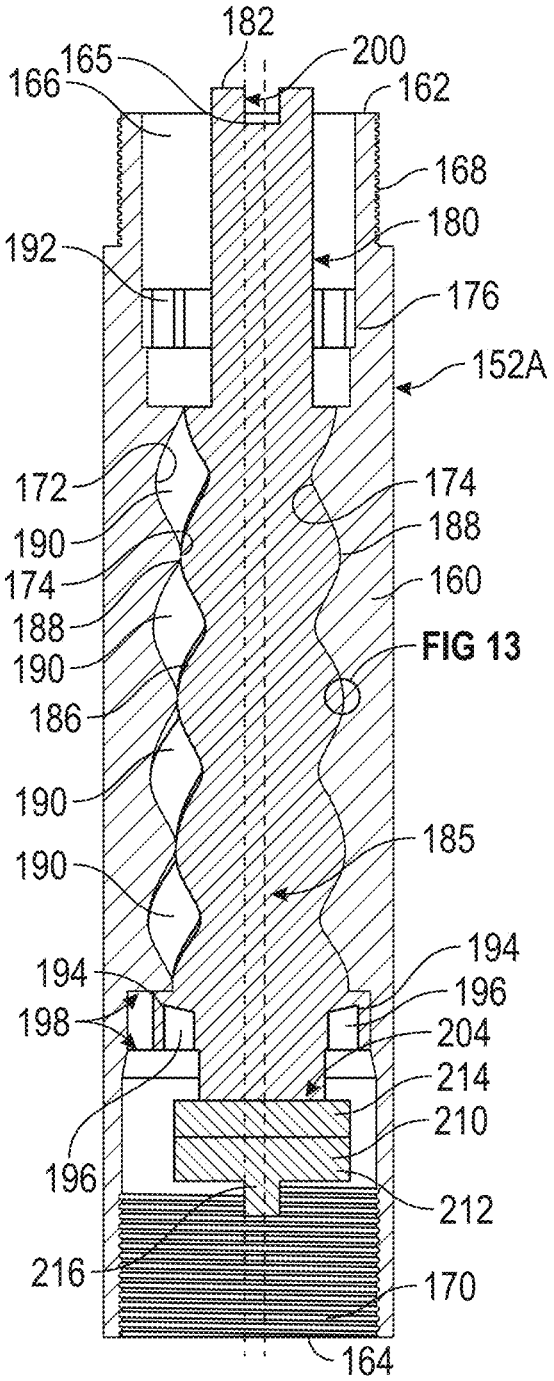
FIG. 12 is a side cross-sectional view of a progressing cavity stage of the multi-stage progressing cavity device of FIG. 9 in a first position.
Figure 13:
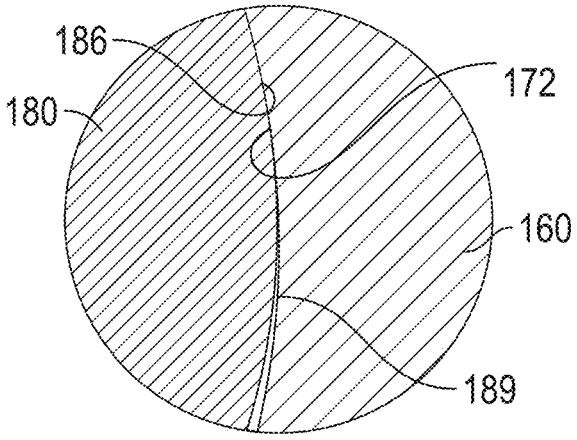
FIG. 13 is a zoomed-in, side cross-sectional view of the progressing cavity stage of FIG. 12.
Figure 14:
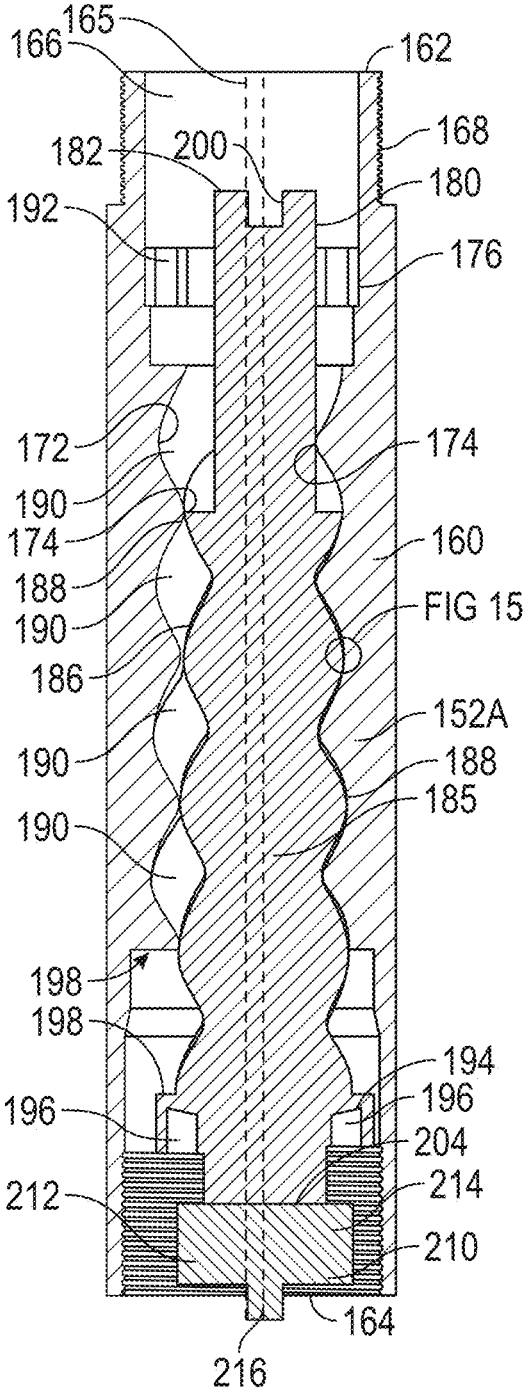
FIG. 14 is a side cross-sectional view of the progressing cavity stage of FIG. 12 in a second position.
Figure 15:
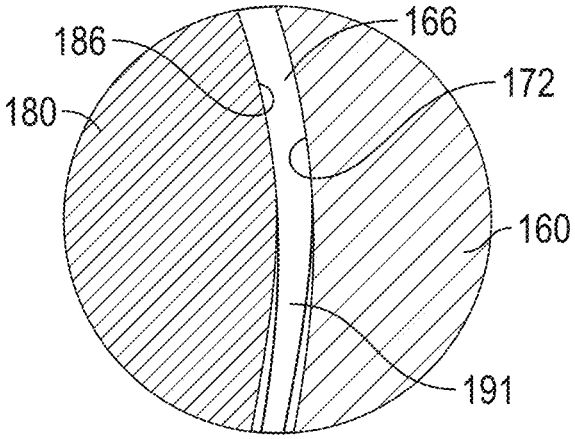
FIG. 15 is a zoomed-in, side cross-sectional view of the progressing cavity stage of FIG. 12 in the second position.

Referring to FIGS. 7, 8, another embodiment of a tapered PC device 100 is shown. Tapered PC device 100 may be employed as a progressing cavity pump or a progressing cavity motor. Tapered PC device 100 generally includes a rotor 120 rotatably disposed within a stator 102. Stator 102 of tapered PC device 100 may be similar in configuration to stator 52 of the PC device 50 shown in FIGS. 3-6 and includes a helical throughbore 104 defining a radially inner helical surface 106 tapered along fixed taper angle θ. Helical surface 106 of stator 102 includes a plurality of circumferentially spaced stator lobes 108.

Rotor 120 of tapered PC device 100 may be similar in configuration to rotor 70 of the tapered PC device 50 shown in FIGS. 3-6 and includes a helical-shaped radially outer surface 122 tapered along fixed taper angle θ. Outer surface 122 of rotor 120 defines a plurality of circumferentially spaced rotor lobes 124 which intermesh with stator lobes 108. Rotor 120 of tapered PC device 100 includes a first or operational position (shown in FIG. 7) and a second or flush-by position (shown in FIG. 8) that is axially spaced from the operational position relative to stator 102. When rotor 120 is in the operational position, a series of cavities 110 are formed between the helical-shaped outer surface 122 of rotor 120 and the helical-shaped inner surface 106 of stator 102. Each cavity 110 is sealed from adjacent cavities 110 by seals 112 formed along the contact lines between rotor 120 and stator 102. However, when rotor 120 is in the flush-by position, the seals 112 formed between adjacent cavities 110 are eliminated and replaced by clearances 114, thereby permitting fluid flow directly between adjacent cavities 110 to assist with the flushing of solids from tapered PC device 100.

Referring to FIGS. 9-17, an embodiment of a multi-stage PC device 150 is shown. Multi-stage PC device 150 may be employed as a progressing cavity pump or a progressing cavity motor. Multi-stage PC device 150 generally includes a first or upper PC stage 152A, a second or intermediate PC stage 152B, a third or lower PC stage 152C, and a rotor catch or stop 154. Although in the embodiment of FIGS. 9-17 multi-stage PC device 150 has three PC stages 152A-1520, in other embodiments, multi-stage PC device 150 may have fewer than three PC stages or more than three PC stages.

Each PC stage 152A-1520 of multi-stage PC device 150 generally includes a rotor 180 rotatably disposed in a corresponding stator 160. As shown particularly in FIGS. 12-15, the stator 160 of each PC stage 152A-1520 has a central or longitudinal axis 165, a first or upper end 162, a second or lower end 164, and a throughbore 166 extending between ends 162, 164. Upper end 162 includes a releasable or threaded connector 168 formed on an outer surface of stator 160, forming a pin connector at the upper end 162 of stator 160. Lower end 164 includes a releasable or threaded connector 170 formed on a cylindrical inner surface of stator 160, forming a box connector at the lower end 164 of stator 160. At least a portion of the inner surface of stator 160 comprises radially inner helical surface 172 that includes a plurality of circumferentially spaced stator lobes 174.

The rotor 180 of each PC stage 152A-1520 has a central or longitudinal axis 185, a first or upper end 182, a second or lower end 184 (shown in FIG. 16), and an outer surface extending between ends 182, 184. At least a portion of the outer surface of rotor 180 comprises a helical-shaped radially outer surface 186 that includes a plurality of circumferentially spaced rotor lobes 188. In this embodiment, stator 160 and rotor 180 each comprise a nearly rigid (e.g., metallic) material, and thus the helical-shaped radially outer surface 186 of rotor 180 and the radially inner helical surface 172 of stator 160 are each nearly rigid (stator 160 does not include an elastomeric liner). Additionally, helical-shaped radially outer surface 186 and radially inner helical surface 172 are each tapered along fixed taper angle θ; however, in other embodiments, surfaces 172, 186 may not be tapered. Rotor 180 of each PC stage 152A-1520 includes a first or operational position (shown in FIG. 12) and a second or flush-by position (shown in FIG. 14) that is axially spaced from the operational position relative to stator 160.

When helical-shaped radially outer surface 186 of rotor 180 is in the operational position and at maximum eccentricity relative to stator 160, a contact or seal line 189 (shown in FIG. 13) extends from an upper end of the helical-shaped radially outer surface 186 of rotor 180 to the a lower end of helical-shaped radially outer surface 186, restricting fluid from flowing directly between adjacently positioned cavities 190 formed between the helical-shaped outer surface 186 of rotor 180 and the helical-shaped inner surface 172 of stator 160. However, when rotor 180 is in the flush-by position and at maximum eccentricity relative to stator 160, seal line 189 is eliminated and a bypass flowpath 191 (shown in FIG. 15) is formed between the upper and lower ends of the helical-shaped radially outer surface 186 of rotor 180, thereby permitting fluid flow directly between adjacent cavities 190 to assist with the flushing of solids from multi-stage PC device 150. In this embodiment, the maximum relative axial movement between the rotor 180 and stator 160 of each PC stage 152A-1520 is limited by rotor stop 154; however, in other embodiments, the relative amount of axial travel between rotor 180 and stator 160 of each PC stage 152A-1520 may be controlled through other mechanisms. The rotor 180 of each PC stage 152A-152C may be actuated between the operational and flush-by positions by applying an axially directed mechanical force (e.g., via a shaft coupled to rotor 180), gravity (e.g., off bottom weight of a BHA), actuation of an active drive assembly (e.g., powered by an electric submersible motor, etc.), by adjusting the direction of fluid flow through multi-stage PC device 150, or through other mechanisms.

In this embodiment, each PC stage 152A-152C includes a first or upper radial bearing 192 positioned between the upper end of the helical-shaped radially outer surface 186 of rotor 180 and the upper end 162 of stator 160, and a second or lower radial bearing 194 positioned between the lower end of the helical-shaped radially outer surface 186 of rotor 180 and the lower end 164 of stator 160. Rotor 180 is permitted to travel axially relative to upper radial bearing 192, which is seated against an annular bearing seat 176 defined by the inner surface of stator 160, while rotor 180 is axially locked to lower radial bearing 194.

Radial bearings 192, 194 are positioned radially between stator 160 and rotor 180 and resist radial loads imparted to rotor 180, restrain the eccentric orbit of rotor 180, and minimize wear between the inner surface of stator 160 and the outer surface of rotor 180. In this embodiment, lower radial bearing 194 includes a plurality of circumferentially spaced fluid passages 196 extending therethrough that permit fluid flow through lower radial bearing 194. Additionally, each PC stage 152A-152C includes a thrust bearing 198 for resisting axially directed loads imparted to rotor 180, thrust bearing 198 positioned axially between a lower end of the radially inner helical surface 172 of stator 160 and an upper end of the lower radial bearing 194.

The rotor 180 of each PC stage 152A-152C also includes a first or upper drive groove 200 that extends axially into the upper end 182 of rotor 180 and a second or lower drive groove 204 that extends axially into the lower end 184 of rotor 180. Multi-stage PC device 150 includes a plurality of slidable drive connectors 210. Drive connectors 210 rotatably couple adjacently positioned rotors 180 of multi-stage PC device 150. As shown particularly in FIGS. 11, 16, in this embodiment, each drive connector 210 includes a generally cylindrical body 212, a first or upper drive key 214 extending from an upper end of body 212, and a second or lower drive key 216 extending from a lower end of body 212. Upper drive key 214 extends along a longitudinal axis 215 that is disposed at a non-zero angle relative to a longitudinal axis 217 along which lower drive key 216 extends. In this embodiment, longitudinal axis 215 is disposed at about a ninety degree angle to longitudinal axis 217; however, in other embodiments, the angle formed between axes 215, 217 may vary.

The upper drive key 214 of a first or upper drive connector 210 is insertable into the lower drive groove 204 of the rotor 180 of upper PC stage 152A while the lower drive key 216 of upper drive connector 210 is insertable into the upper drive groove 200 of the rotor 180 of intermediate PC stage 152B to form a slidable connection 205 between the rotors 180 of PC stages 152A, 152B. Similarly, the upper drive key 214 of a second or lower drive connector 210 is insertable into the lower drive groove 204 of the rotor 180 of intermediate PC stage 152B while the lower drive key 216 of lower drive connector 210 is insertable into the upper drive groove 200 of the rotor 180 of lower PC stage 152C form a slidable connection 205 between the rotors 180 of PC stages 152B, 152C. In this manner, the slidable connection 205 formed between the rotors 180 of PC stages 152A, 152B, permits the central axis 185 of the rotor 180 of upper PC stage 152A to be laterally or radially spaced or offset from the central axis 185 of the rotor 180 of intermediate PC stage 152B. Similarly, the slidable connection 205 formed between the rotors 180 of PC stages 152B, 152C, permits the central axis 185 of the rotor 180 of intermediate PC stage 152B to be radially spaced or offset from the central axis 185 of the rotor 180 of lower PC stage 152C.

Further, given that the longitudinal axis 215 of the upper drive key 214 of each drive connector 210 is disposed at an angle relative to the longitudinal axis 217 of lower drive key 216, the central axes 185 of adjacently positioned rotors 180 may be offset in two orthogonal dimensions. For example, the central axis 185 of the rotor 180 of upper PC stage 152A ("the upper rotor 180") may be offset from the central axis 185 of the rotor 180 of intermediate PC stage 152B ("the intermediate rotor 180") along longitudinal axis 215 via the slidable engagement between the lower drive groove 204 of the upper rotor 180 and the upper drive key 214 of drive connector 210. Additionally, the central axis 185 of the upper rotor 180 may be offset from the central axis 185 of the intermediate rotor 180 via the slidable engagement between the upper drive groove 200 of the intermediate rotor 180 and the lower drive key 216 of drive connector 210.

Figure 16:
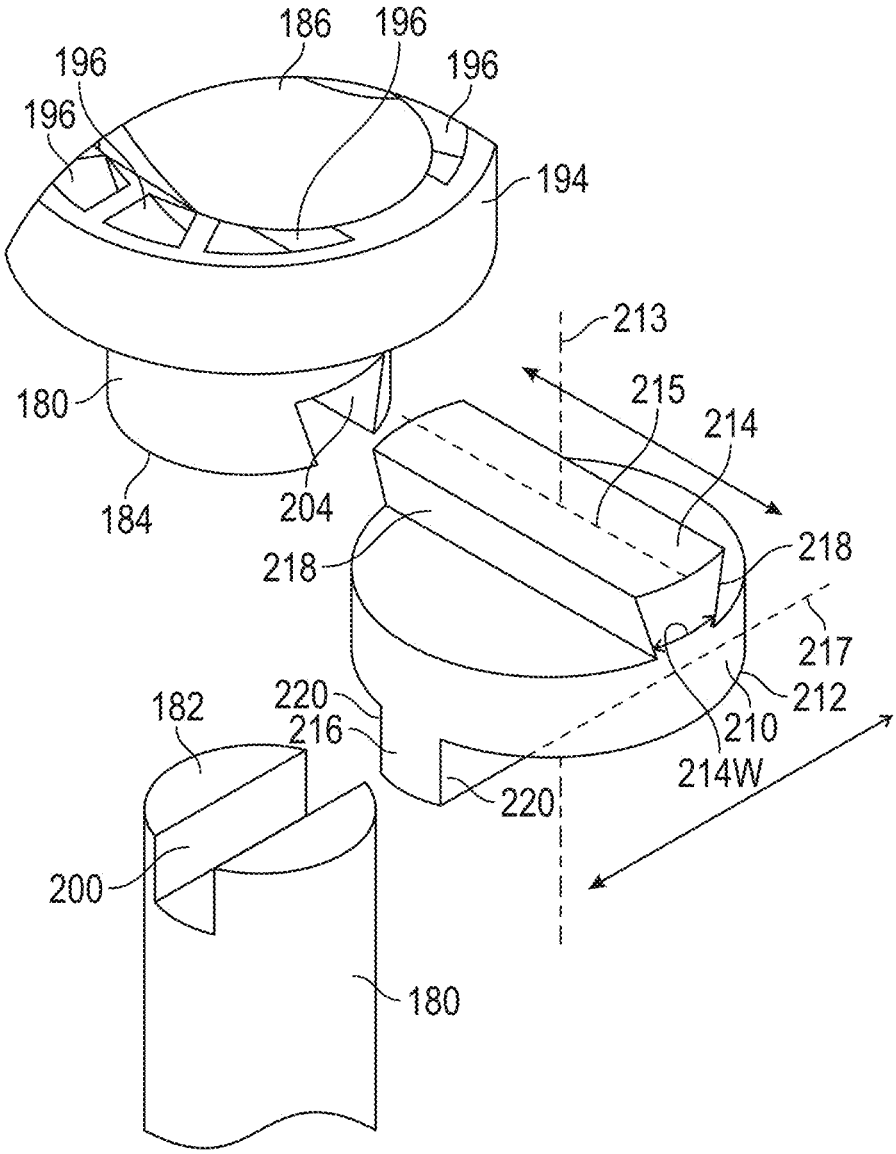
FIG. 16 is a perspective exploded view of the slidable drive connector of FIG. 11.

Still referring to FIGS. 9-17, in this embodiment, the upper drive key 214 of each drive connector 210 has a dovetail cross-sectional profile and includes a pair of planar upper engagement surfaces 218 (shown in FIG. 16) while the lower drive key 216 has a rectangular cross-sectional profile and includes a pair of planar lower engagement surfaces 220 (shown in FIG. 16). Thus, upper engagement surfaces 218 extend along opposing planes which are disposed at an angle (inclined) relative to a longitudinal axis 213 (shown in FIG. 16) of the drive connector 210 while lower engagement surfaces 220 extend along planes which are disposed parallel with longitudinal axis 213.

Additionally, given that upper drive key 214 has a dovetail cross-sectional profile a width 214W (shown in FIG. 16) of upper drive key 214 increases moving from a lower base of upper drive key 214 located at the upper end of body 212 and an upper terminal end of upper drive key 214. In this embodiment, the lower drive groove 204 of each rotor 180 includes a dovetail cross-sectional profile configured to matingly engage upper drive key 214 while the upper drive groove 200 of each rotor 180 comprises a rectangular cross-sectional profile configured to matingly engage lower drive key 216. Relative axial movement is restricted between drive connector 210 and the rotor 180 engaged by the dovetail cross-sectional profile of upper drive key 214. However, relative axial movement is permitted between drive connector 210 and the rotor 180 engaged by the rectangular cross-sectional profile of lower drive key 216. Thus, drive connector 210 permits limited relative axial movement between the adjacently positioned rotors 180 drive connector 210 rotatably connects.

By increasing the number of PC stages of a multi-stage PC device the pressure differential between the fluid flowing into the multi-stage PC device and the fluid exiting therefrom may be increased. Conventional multi-stage PC devices employing stators and rotors having nearly rigid (e.g., metallic) enmeshing surfaces having constant (non-tapered) diameters typically require the rotor of each PC stage to be smaller than optimal to permit the rotor to be fully inserted into the corresponding stator of the PC stage, reducing the volumetric efficiency of each PC stage and thereby requiring additional PC stages to produce a given pressure differential across the conventional multi-stage PC device. The axial length of each PC stage of a conventional multi-stage PC device may be limited given that an increase in axial length of the PC stage requires an additional corresponding clearance between the rotor and stator of the PC stage to permit full insertion of the rotor into the stator, thereby further reducing the volumetric efficiency of the PC stage as the axial length of the PC stage increases. Additionally, the axial length of a single stage tapered PC devices employing a stator and rotor each having a variable (tapered) diameter, such as PC device 50 shown in FIGS. 3-6, may be limited by a minimum practical diameter of the rotor, limiting the maximum pressure differential that may be achieved from the single stage tapered PC device.

Further, in conventional multi-stage PC devices the phasing or timing of the stator of each PC stage (e.g., eliminating any rotational, axial, or angular misalignment between each stator) may require special tooling and be conducted by the manufacturer of the multi-stage PC device at the manufacturing thereof. Conversely, the slidable connection 205 formed between adjacently positioned rotors 180 of multi-stage PC device 150 via drive connectors 210 eliminates the requirement of timing the stators 160 of multi-stage PC device 150 by permitting relative axial movement between adjacently positioned rotors 180 and radial offset between the central axes 185 of rotors 180 while still permitting the transmission of torque therebetween. Thus, drive connectors 210 permits multi-stage PC device 150 to be assembled by threading the stators 160 of PC stages 152A-152C together (with each rotor 180 being inserted into each corresponding stator 160), and then rotating the rotor 180 of lower PC stage 152C until the lower drive key 216 of the drive connector 210 coupled to the rotor 180 of intermediate PC stage 152B engages and is inserted into the upper drive groove 200 of the rotor 180 of lower PC stage 152C.

Given that multi-stage PC device 150 does not need to be pre-assembled by the manufacturer, multi-stage PC device 150, including each PC stage 152A-152C, may be assembled in the field allowing the number of PC stages 152A-152C of multi-stage PC device 150 to be adjusted in the field depending on the needs of the particular application. Additionally, a relatively large number of PC stages 152A-152C may be conveniently assembled together to form multi-stage PC device 150, permitting each PC stage 152A-152C to be relatively axially short to thereby maximize the taper angle of the stator 160 and rotor 180 of each PC stage 152A-152C to assist with in-situ flushing of multi-stage PC device 150. As described above, when it is desired to flush debris from multi-stage PC device 150, the rotors 180 of multi-stage PC device 150 may be actuated to the flush-by position and fluid may be flowed through multi-stage PC device 150 to flush solids and other debris therefrom. Rotor 180 may be actuated between the operational and flush-by positions by applying an axially directed mechanical force (e.g., via a shaft coupled to rotor 70), gravity (e.g., off bottom weight of a BHA), actuation of an active drive assembly (e.g., powered by an electric submersible motor, etc.), by adjusting the direction of fluid flow through tapered PC device 50, or through other mechanisms.

Figure 18:
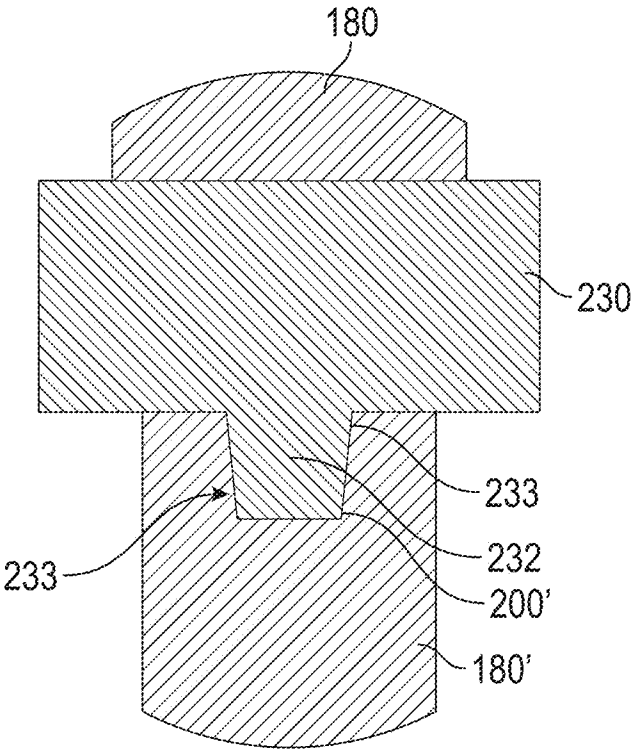
FIG. 18 is a side cross-sectional view of another embodiment of a slidable drive connector in accordance with principles disclosed herein.
Figure 17:
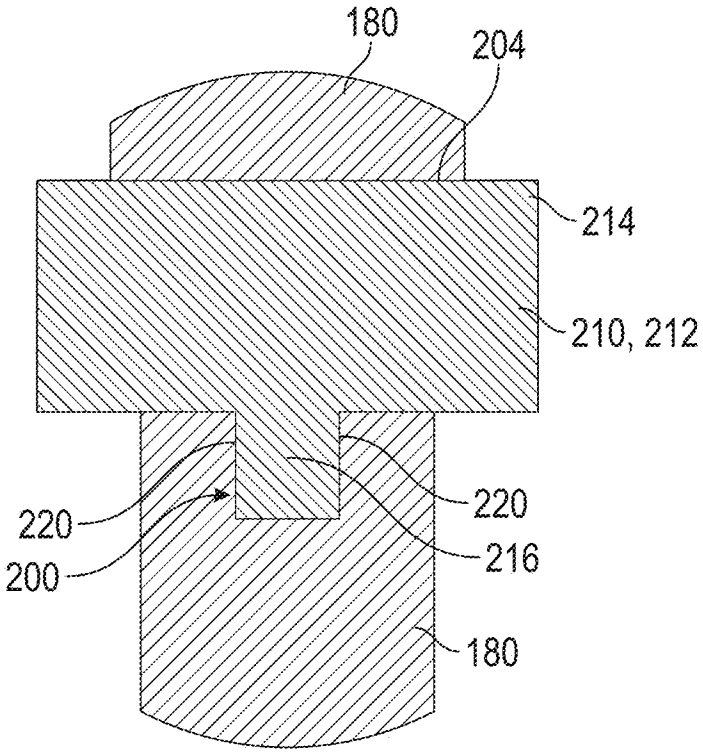
FIG. 17 is a side cross-sectional view of the slidable drive connector of FIG. 11.

Although in this embodiment the lower drive key 216 of each drive connector 210 has a rectangular cross-sectional profile, in other embodiments, the cross-sectional profile of lower drive key 216 may vary. For instance, referring to FIGS. 18-23B, a slidable drive connector 230 (shown in FIG. 18) includes a tapered lower drive key 232 comprising a pair of planar lower engagement surfaces 233. Tapered lower drive key 232 is receivable in a rotor 180' including a tapered upper drive groove 200' that matingly engage lower drive key 232. Tapered lower drive key 232 increases the ease by which lower drive key 232 may be inserted into the tapered upper drive groove 200' of rotor 180'. Additionally, the tapered or inclined engagement surfaces 233 of tapered lower drive key 232 permit the release of debris trapped between lower drive key 232 and upper drive groove 200' during disengagement of lower drive key 232 from upper drive groove 200', thereby increasing the ease of disengagement of lower drive key 232 from upper drive groove 200'.

Figure 19:
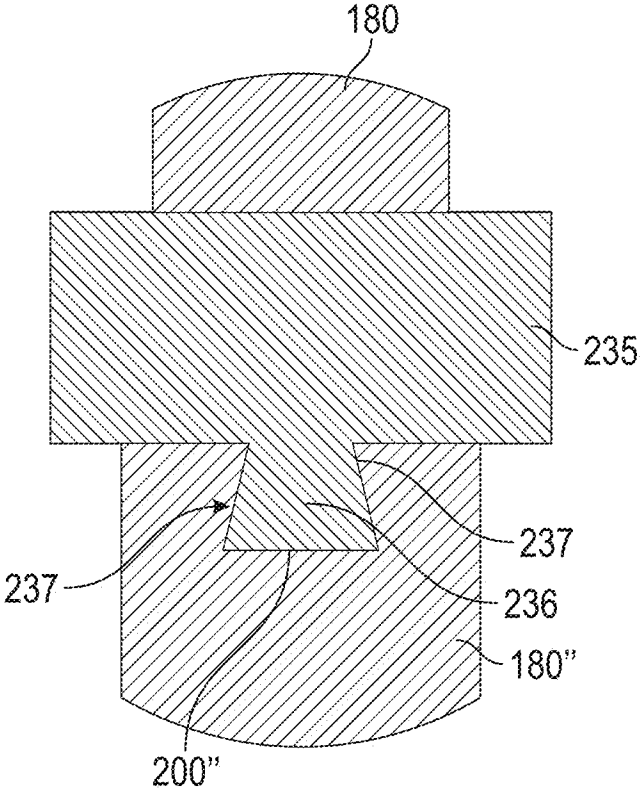
FIG. 19 is a side cross-sectional view of another embodiment of a slidable drive connector in accordance with principles disclosed herein.

FIG. 19 illustrates a slidable drive connector 235 including a lower drive key 236 having a dovetail cross-sectional profile and comprising a pair of planar engagement surfaces 237. Lower drive key 236 is similar in configuration to the upper drive key 214 of drive connector 210 and is receivable in a rotor 180" including a tapered upper drive groove 200" that matingly engage lower drive key 236. Thus, the dovetail interlocking engagement formed between lower drive key 236 and upper drive groove 200" restricts relative axial movement between drive connector 235 and rotor 180".

Figure 20:
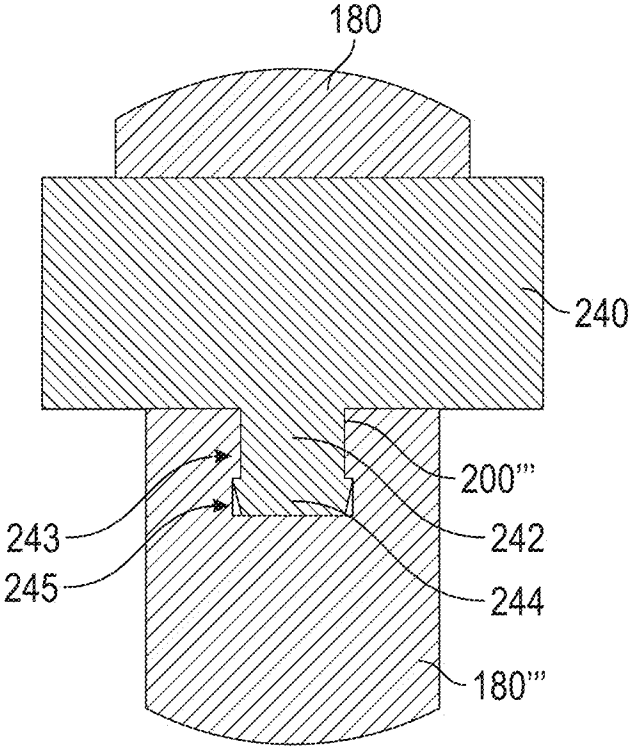
FIG. 20 is a side cross-sectional view of another embodiment of a slidable drive connector in accordance with principles disclosed herein.

FIG. 20 illustrates a slidable drive connector 240 including a lower drive key 242 that includes a neck 243 extending from body 212 of drive connector 240 and a head or plug 244 disposed at a terminal end of neck 243, head 244 having a greater lateral width than neck 243. Head 244 is receivable in a socket 245 formed in an upper drive groove 200''' of a rotor 180'''. In the embodiment of FIG. 20, head 244 of lower drive key 242 must elastically deform when inserted through upper drive groove 200''' and into socket 245, and thus, an axially directed, tensile force must be applied to drive connector 240 and/or rotor 180*m* in order to release lower drive key 242 from groove 200''' of rotor 180'''. Drive connector 240 may be advantageous in applications where it is desirable to apply tensile forces to rotor 180''' without releasing rotor 180''' from drive connector 240.

Figure 21:
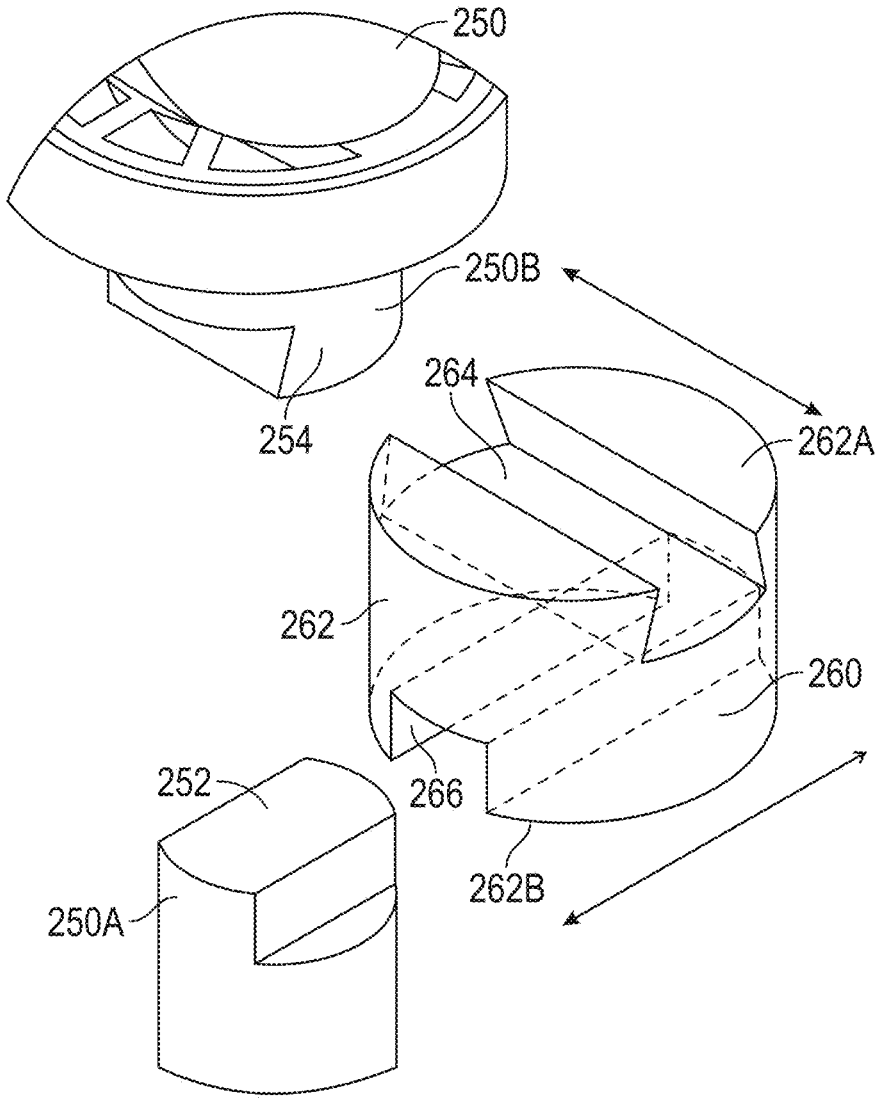
FIG. 21 is a perspective exploded view of another embodiment of a slidable drive connector in accordance with principles disclosed herein.

FIG. 21 illustrates a pair of adjacently positioned rotors 250 and a slidable drive connector 260. A first or upper rotor 250 may comprise the rotor 250 of upper PC stage 152A or intermediate PC stage 152B while a second or lower rotor 250 may comprise the rotor 250 of intermediate PC stage 152B or lower PC stage 152C. Rotors 250 are similar in configuration to rotors 180 shown in FIGS. 9-17 except that an upper end 250A of each rotor 250 comprises an upper drive key 252 while a lower end 250B of each rotor comprises a lower drive key 254. In the embodiment of FIG. 21, drive connector 260 includes a body 262 having a first end 262A and a second end 262B opposite first end 262A. An upper drive groove 264 extends into body 262 from first end 262A while a lower drive groove 266 extends into body 262 from lower end 262B. The lower drive key 254 of the upper rotor 250 is insertable into the upper drive groove 264 of drive connector 250 and the upper drive key 252 of the lower rotor 250 is insertable into the lower drive groove 266 of drive connector 260 to form a slidable connection (similar in functionality to slidable connections 205 shown in FIG. 9) between the upper and lower rotors 250 via drive connector 250.

Figure 22B:
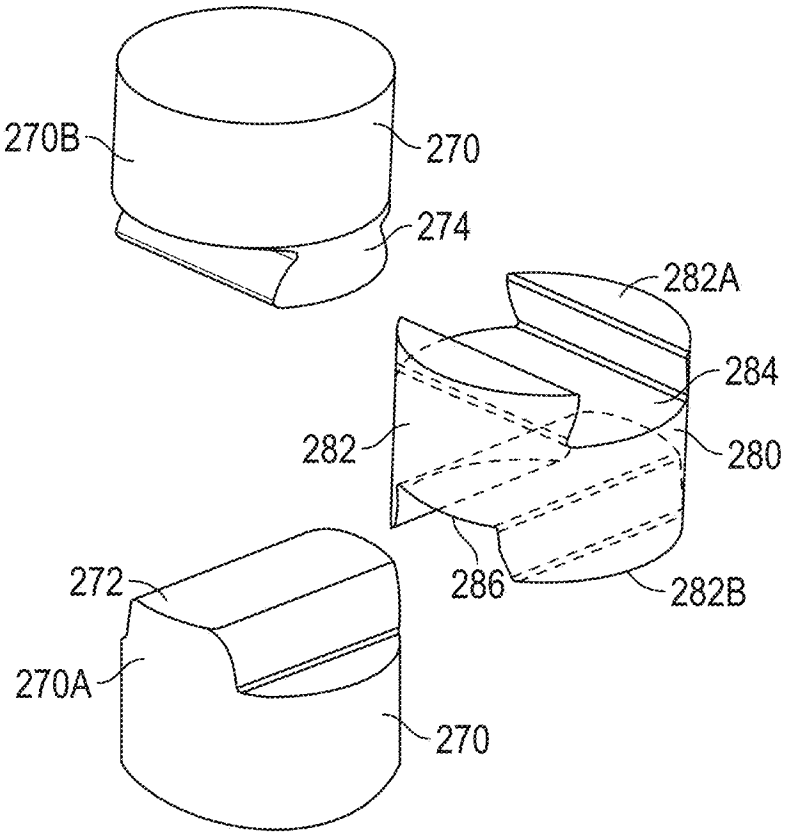
FIG. 22B is a perspective exploded view of the slidable drive connector of FIG. 22A.
Figure 22A:
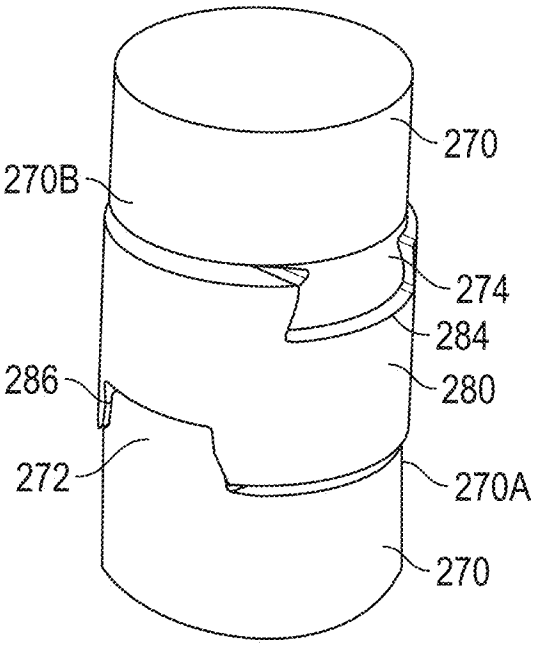
FIG. 22A is a perspective view of another embodiment of a slidable drive connector in accordance with principles disclosed herein.

FIGS. 22A, 22B illustrate a pair of adjacently positioned rotors 270 and a slidable drive connector 280. An upper end 270A of each rotor 270 comprises an upper drive key 272 while a lower end 270B of each rotor comprises a lower drive key 274. Drive connector 280 includes a body 282 having a first end 282A and a second end 282B opposite first end 282A. An upper drive groove 284 extends into body 282 from first end 282A while a lower drive groove 286 extends into body 282 from lower end 282B. The lower drive key 274 of the upper rotor 270 is insertable into the upper drive groove 284 of drive connector 280 and the upper drive key 272 of the lower rotor 270 is insertable into the lower drive groove 286 of drive connector 280 to form a slidable connection (similar in functionality to slidable connections 205 shown in FIG. 9) between the upper and lower rotors 270 via drive connector 280. The lower drive key 274 of rotors 270 and the upper drive groove 284 of drive connector 280 each comprise a locking, rounded dovetail shape or profile which restrict relative axial movement between the upper rotor 270 and drive connector 280. The upper drive key 272 of rotors 270 and the lower drive groove 286 of drive connector 280 each comprise a rounded trapezoidal cross-sectional shape or profile which permits relative axial movement between the lower rotor 270 and drive connector 280.

Figure 23B:
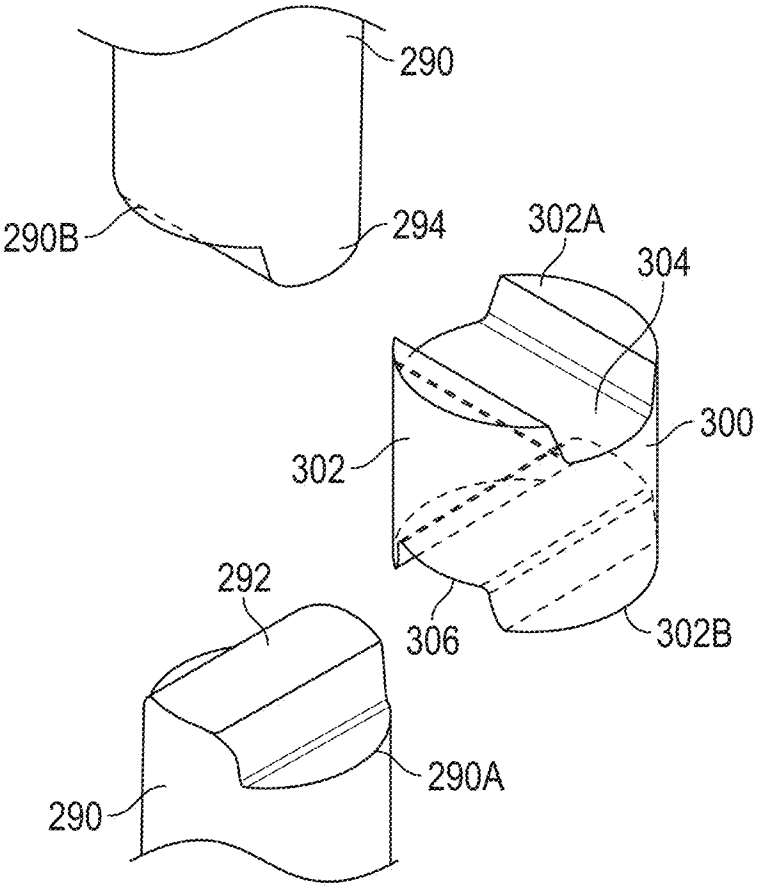
FIG. 23B is a perspective exploded view of the slidable drive connector of FIG. 23A.
Figure 23A:
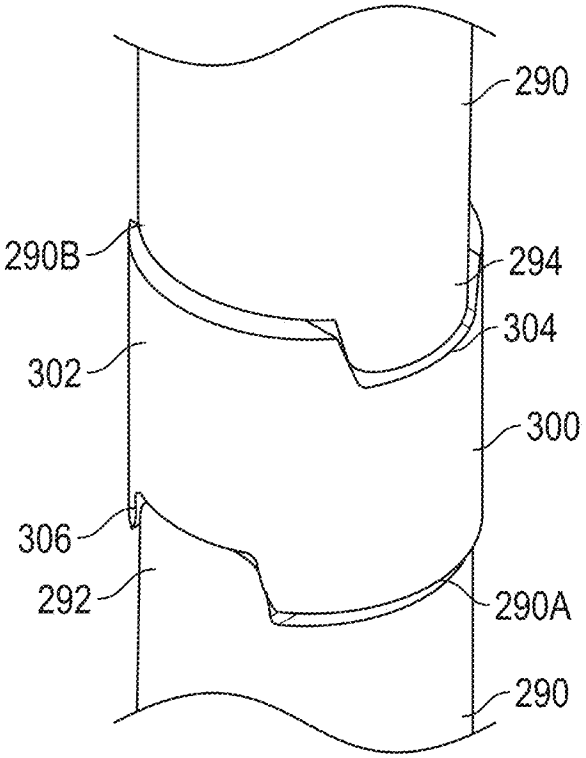
FIG. 23A is a perspective view of another embodiment of a slidable drive connector in accordance with principles disclosed herein.

FIGS. 23A, 23B illustrate a pair of adjacently positioned rotors 290 and a slidable drive connector 300. An upper end 290A of each rotor 290 comprises an upper drive key 292 while a lower end 290B of each rotor comprises a lower drive key 294. Drive connector 300 includes a body 302 having a first end 302A and a second end 302B opposite first end 302A. An upper drive groove 304 extends into body 302 from first end 302A while a lower drive groove 306 extends into body 302 from lower end 302B. The lower drive key 294 of the upper rotor 290 is insertable into the upper drive groove 304 of drive connector 300 and the upper drive key 292 of the lower rotor 290 is insertable into the lower drive groove 306 of drive connector 300 to form a slidable connection (similar in functionality to slidable connections 205 shown in FIG. 9) between the upper and lower rotors 290 via drive connector 300. The lower drive key 294 of rotors 290 and the upper drive groove 304 of drive connector 300 each comprise a rounded trapezoidal cross-sectional shape or profile. The upper drive key 292 of rotors 290 and the lower drive groove 306 of drive connector 300 each also comprise a rounded trapezoidal cross-sectional shape or profile. Thus, unlike the upper rotor 270 and drive connector 280 shown in FIGS. 22A, 22B, relative axial movement is permitted between upper rotor 290 and drive connector 300.

The drive keys 272, 274, 292, and 294 of rotors 270, 290, respectively, and the drive grooves 284, 286, 304, and 306 of drive connectors 280, 300, respectively, each feature rounded or curved edges which minimize contact stresses resulting between physical engagement between drive keys 272, 274, 292, 294 and drive grooves 284, 286, 304, 306, thereby increasing the operational life of rotors 270, 290 and drive connectors 280, 300. Additionally, the curved edges of drive keys 272, 274, 292, 294 and drive grooves 284, 286, 304, 306 act as curved contact surfaces between drive keys 272, 274, 292, 294 and drive grooves 284, 286, 304, 306 and are permitted to move in concert with rotors 270, 290 and drive connectors 280, 300 to assist with providing a smoother operation of rotors 270, 290 and drive connectors 280, 300, particularly when rotors 270, 290 are disposed at an oblique angle relative to drive connectors 280, 300. In this manner, the curved edges or contact surfaces of drive keys 272, 274, 292, 294 and drive grooves 284, 286, 304, 306 thereby minimize contact stress and friction between the drive keys 272, 274, 292, 294 and corresponding drive grooves 284, 286, 304, 306 during the operation of rotors 270, 290 and drive connectors 280, 300, as well as encourage cleaning and lubrication of the couplings formed therebetween by providing space for solids and fluids to flow therethrough.

Figure 24B:
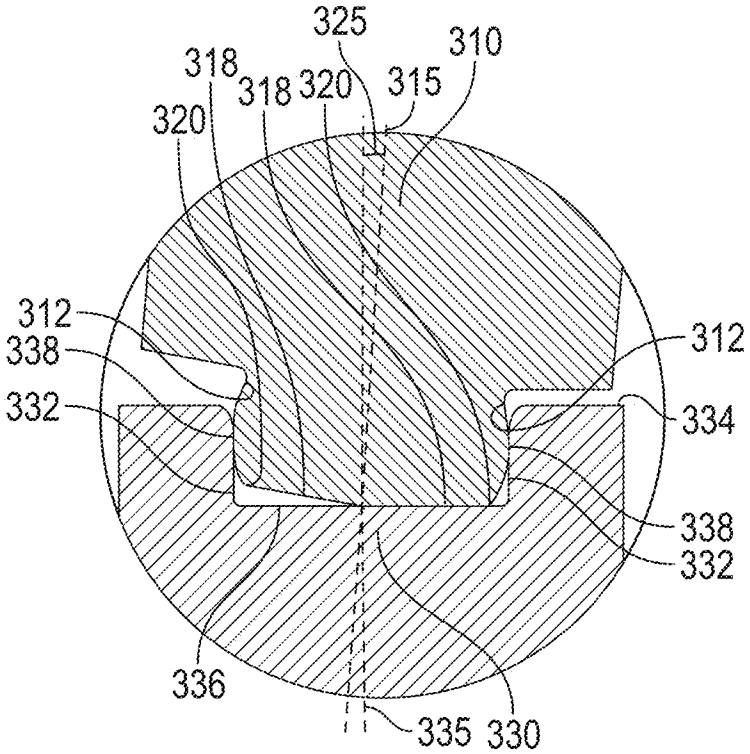
FIGS. 24A, 24B are side cross-sectional views of another embodiment of a slidable drive connector in accordance with principles disclosed herein.
Figure 24A:
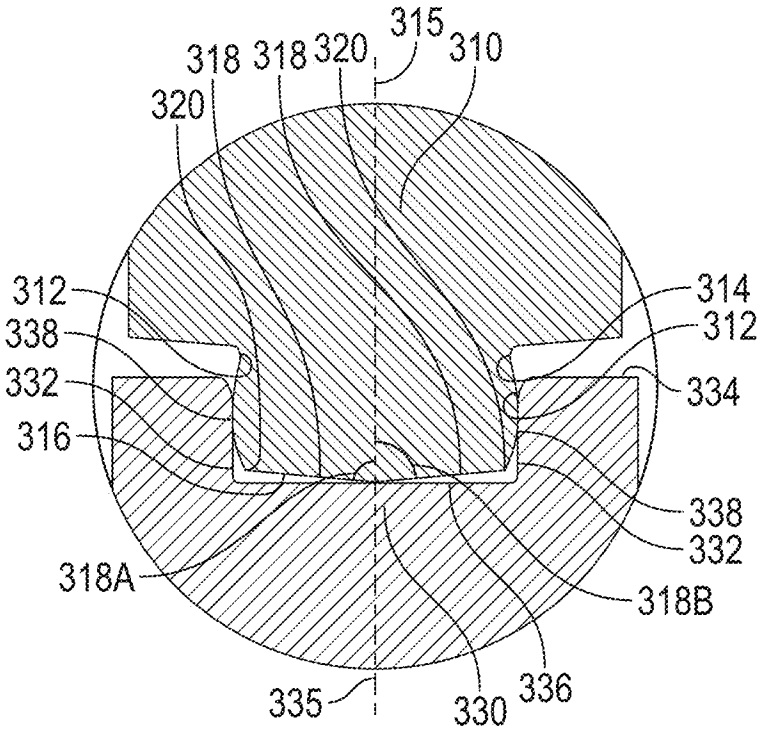

Referring to FIGS. 24A-33B, additional embodiments of drive keys and drive grooves of a multi-stage PC device are shown. Particularly, FIGS. 24A, 24B illustrate a rounded drive key 310 inserted into a rounded drive groove 330 to form a slidable connection that permits the transmission of torque between drive key 310 and drive groove 330. Drive key 310 may form part of either a rotor or a drive connector in different embodiments, and similarly, drive groove 330 may also form part of either a rotor or a drive connector in different embodiments.

Drive key 310 has a body central or longitudinal axis 315 (e.g., the longitudinal axis of the body—rotor, drive connector, etc.—to which drive key 310 is attached) and includes a pair of flanking convex bearings surfaces 312 that extend between a root 314 of drive key 310 to an end face 316 thereof. End face 316 of drive key 310 is defined by a pair of beveled surfaces 318. In the embodiment of FIGS. 24A, 24B, a first angle 318A formed between beveled surface 318 and longitudinal axis 315 is between about 83° and 90°. Additionally, a second angle 318B, opposite first angle 318A, and formed between beveled surface 318 and longitudinal axis 315 is between about 83° and 90°; however, in other embodiments, the angle 318A, 318B formed between beveled surfaces 318 may vary. A pair of outer edges 320 is formed at the interface between the pair of convex bearing surfaces 312 and the beveled surfaces 318 defining end face 316. Drive key 310 has a generally rectangular cross-section such that a lateral width of drive key 310 (the width extending laterally between bearing surfaces 312) at root 314 is about equal to the lateral width of drive key 310 at end face 316. Drive groove 330 has a body central or longitudinal axis 335 (e.g., the longitudinal axis of the body—rotor, drive connector, etc.—in which drive groove 330 is formed) and includes a pair of flanking convex bearing surfaces 332 which extend between an upper end face 334 and a terminal end or bottom face 336. Drive groove 330 has a generally rectangular cross-section such that a lateral width of drive groove 330 (the width extending laterally between bearing surfaces 332) at end face 334 is about equal to the lateral width of drive groove 330 at bottom face 336.

Drive key 310 may angularly flex or pivot relative drive groove 330 between an angularly aligned position (shown in FIG. 24A) and a position of maximum angular misalignment (shown in FIG. 24B) where one of the edges 320 of drive key 310 engages the bottom face 336 of drive groove 330. When drive key 310 is in the position of maximum angular misalignment a maximum misalignment angle 325 (shown in FIG. 24B) is formed between axes 315, 335. Thus, drive key 310 and drive groove 330 allow for axial offset between axes 315, 335 (lateral spacing between axes 315, 335), angular offset between axes 315, 335 (formation of maximum misalignment angle 325 between axes 315, 335), and relative axial movement between drive key 310 and drive groove 330 while still permitting the transmission of torque therebetween. In the embodiment of FIGS. 24A, 24B, the maximum misalignment angle 325 is between about 83° and 90°; however, in other embodiments, the maximum misalignment angle 325 formed between axes 315, 335 may vary. The convex bearing surfaces 312 and 332 of drive key 310 and drive groove 330, respectively, maintain a consistent contact location 338 between surfaces 312, 332 as drive key 310 pivots between the angularly aligned position and the position of maximum angular misalignment. By maintaining a consistent contact location 338, contact stress and friction may be minimized between drive key 310 and drive groove 330 as drive key 310 moves between angularly aligned and angularly misaligned positions.

Figure 26:
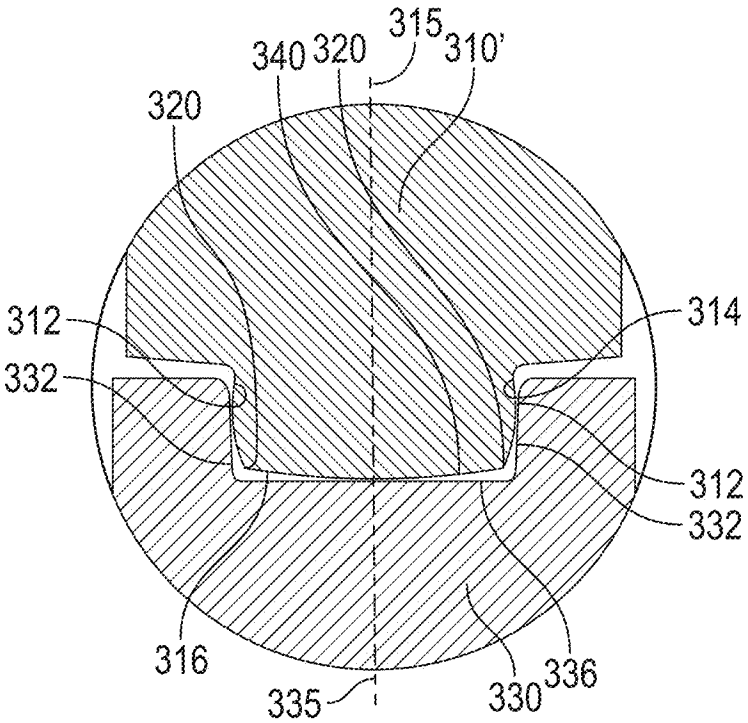
FIG. 26 is a side cross-sectional view of another embodiment of a slidable drive connector in accordance with principles disclosed herein.

Another embodiment of drive key 310' is shown in FIG. 26 that is similar to the drive key 310 of FIGS. 24A, 24B, except that the end face 316 of drive key 310' is defined by a curved or crowned surface 340 extending between edges 320.

Figure 25B:
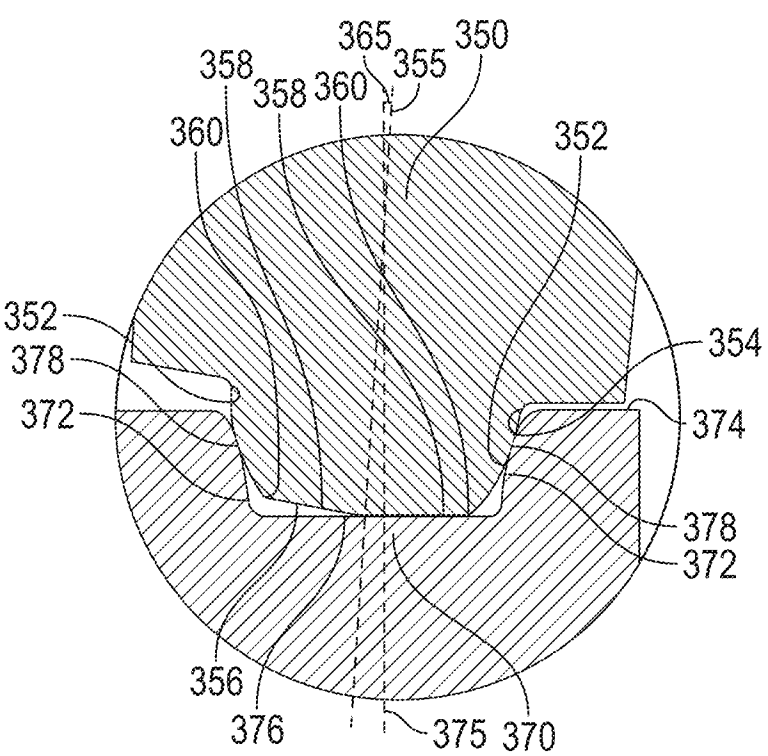
FIGS. 25A, 25B are side cross-sectional views of another embodiment of a slidable drive connector in accordance with principles disclosed herein.
Figure 25A:
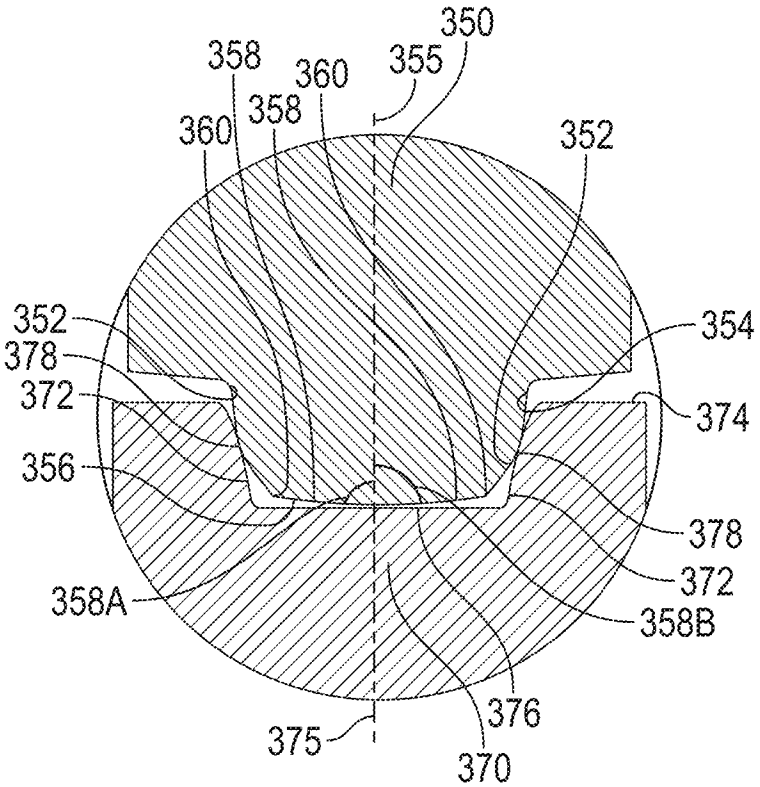

FIGS. 25A, 25B illustrate a drive key 350 inserted into a drive groove 370 to form a slidable connection that permits the transmission of torque between drive key 350 and drive groove 370. Drive key 350 may form part of either a rotor or a drive connector in different embodiments, and similarly, drive groove 370 may also form part of either a rotor or a drive connector in different embodiments. Drive key 350 has a body central or longitudinal axis 355 and includes a pair of flanking convex bearings surfaces 352 that extend between a root 354 of drive key 350 to an end face 356 thereof. End face 356 of drive key 350 is defined by a pair of beveled surfaces 358. In the embodiment of FIGS. 25A, 25B, a first angle 358A formed between beveled surface 358 and longitudinal axis 355 is between about 83° and 90°. Additionally, a second angle 358B, opposite first angle 358A, and formed between beveled surface 358 and longitudinal axis 355 is between about 83° and 90°; however, in other embodiments, the angles 358A, 358B formed between beveled surfaces 358 may vary. A pair of outer edges 360 is formed at the interface between the pair of beveled convex bearing surfaces 352 and the beveled surfaces 358 defining end face 356. Drive key 350 has a rounded trapezoidal cross-section such that a lateral width of drive key 350 (the width extending laterally between bearing surfaces 352) at root 354 is greater than the lateral width of drive key 350 at end face 356.

Drive groove 370 has a body central or longitudinal axis 375 and includes a pair of flanking convex bearing surfaces 372 which extend between an upper end face 374 and a terminal end or bottom face 376. Drive groove 370 has a rounded trapezoidal cross-section such that a lateral width of drive groove 370 (the width extending laterally between bearing surfaces 372) at end face 374 is greater than the lateral width of drive groove 370 at bottom face 376. Drive key 350 may angularly pivot relative drive groove 370 between an angularly aligned position (shown in FIG. 25A) and a position of maximum angular misalignment (shown in FIG. 25B) where one of the edges 360 of drive key 350 engages the bottom face 376 of drive groove 370, forming a maximum misalignment angle 365 (shown in FIG. 25B) between axes 355, 375. In this embodiment, the maximum misalignment angle 365 is between about 0° and 7°; however, in other embodiments, the maximum misalignment angle 365 may vary. The convex bearing surfaces 352 and 372 of drive key 350 and drive groove 370, respectively, maintain a consistent contact location 378 between surfaces 352, 372 as drive key 350 pivots between the angularly aligned position and the position of maximum angular misalignment.

Figure 27:
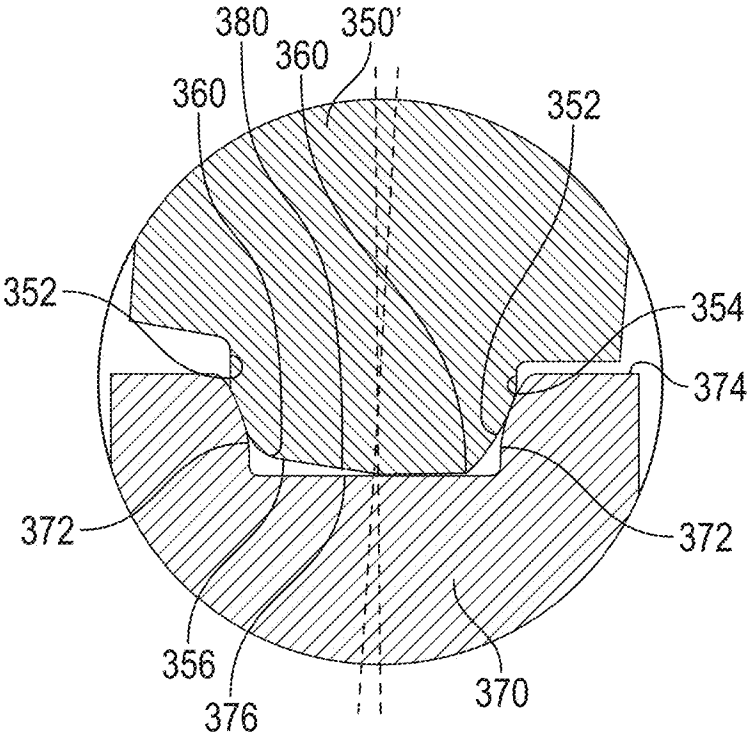
FIG. 27 is a side cross-sectional view of another embodiment of a slidable drive connector in accordance with principles disclosed herein.

Another embodiment of drive key 350' is shown in FIG. 27 that is similar to the drive key 350 of FIGS. 25A, 25B, except that the end face 356 of drive key 350' is defined by a curved or crowned surface 380 extending between edges 360.

Figure 28:
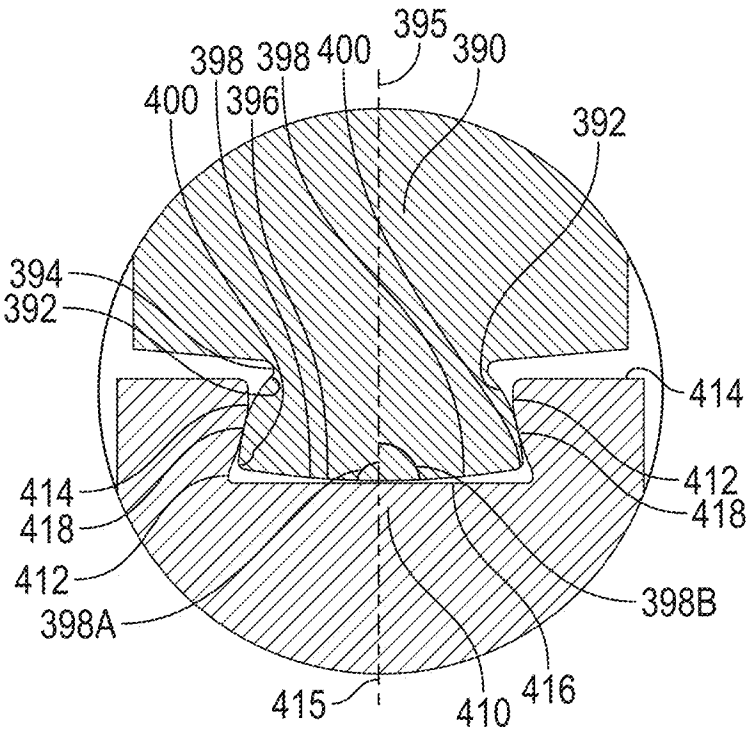
FIG. 28 is a side cross-sectional view of another embodiment of a slidable drive connector in accordance with principles disclosed herein.

FIG. 28 illustrates a drive key 390 inserted into a drive groove 410 to form a slidable connection that permits the transmission of torque between drive key 390 and drive groove 410. Drive key 390 may form part of either a rotor or a drive connector in different embodiments, and similarly, drive groove 410 may also form part of either a rotor or a drive connector in different embodiments. Drive key 390 has a body central or longitudinal axis 395 and includes a pair of flanking convex bearings surfaces 392 that extend between a root 394 of drive key 390 to an end face 396 thereof. End face 396 of drive key 390 is defined by a pair of beveled surfaces 398. In the embodiment of FIG. 28, a first angle 398A formed between beveled surface 398 and longitudinal axis 395 is between about 83° and 90°. Additionally, a second angle 398B, opposite first angle 398A, and formed between beveled surface 398 and longitudinal axis 395 is between about 83° and 90°; however, in other embodiments, the angles 398A, 398B formed between beveled surfaces 398 may vary. A pair of outer edges or radius edges 400 is formed at the interface between the pair of beveled convex bearing surfaces 392 and the beveled surfaces 398 defining end face 396. Drive key 390 has a rounded dovetail cross-section such that a lateral width of drive key 390 (the width extending laterally between bearing surfaces 392) at root 394 is less than the lateral width of drive key 390 at end face 396.

Figure 29:
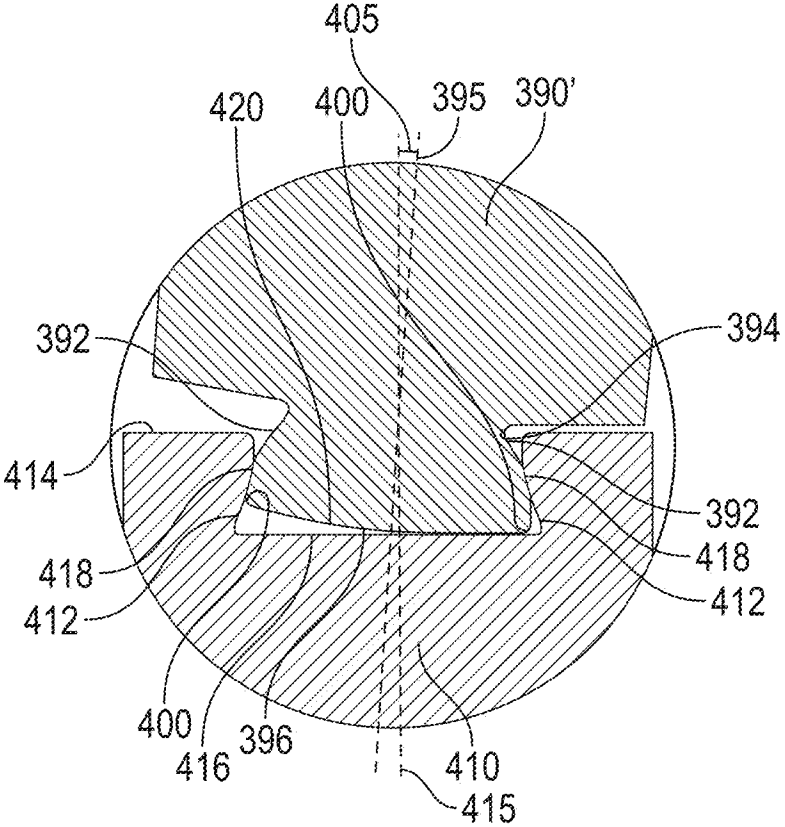
FIG. 29 is a side cross-sectional view of another embodiment of a slidable drive connector in accordance with principles disclosed herein.

Drive groove 410 has a body central or longitudinal axis 415 and includes a pair of flanking convex bearing surfaces 412 which extend between an upper end face 414 and a terminal end or bottom face 416. Drive groove 410 has a rounded dovetail cross-section such that a lateral width of drive groove 410 (the width extending laterally between bearing surfaces 412) at end face 414 is less than the lateral width of drive groove 410 at bottom face 416. Another embodiment of drive key 390' is shown in FIG. 29 that is similar to the drive key 390 of FIG. 28, except that the end face 396 of drive key 390' is defined by a curved or crowned surface 420 extending between edges 400.

Drive key 390/390' may angularly pivot relative drive groove 410 between an angularly aligned position (shown in FIG. 28) and a position of maximum angular misalignment (shown in FIG. 29) where one of the edges 400 of drive key 390/390' engages the bottom face 416 of drive groove 410, forming a maximum misalignment angle 405 (shown in FIG. 29) between axes 395, 415. In this embodiment, the maximum misalignment angle 405 is between about 0° and 7°, however, in other embodiments, the maximum misalignment angle 405 may vary. The convex bearing surfaces 392 and 412 of drive key 390 and drive groove 410, respectively, maintain a consistent contact location 418 between surfaces 392, 412 as drive key 410 pivots between the angularly aligned position and the position of maximum angular misalignment. Additionally, given that drive key 390/390' and drive groove 410 each comprise a rounded dovetail cross-section, relative axial movement is restricted between drive key 390/390' and drive groove 410 when drive key 390/390' is inserted into drive groove 410.

Figure 30B:
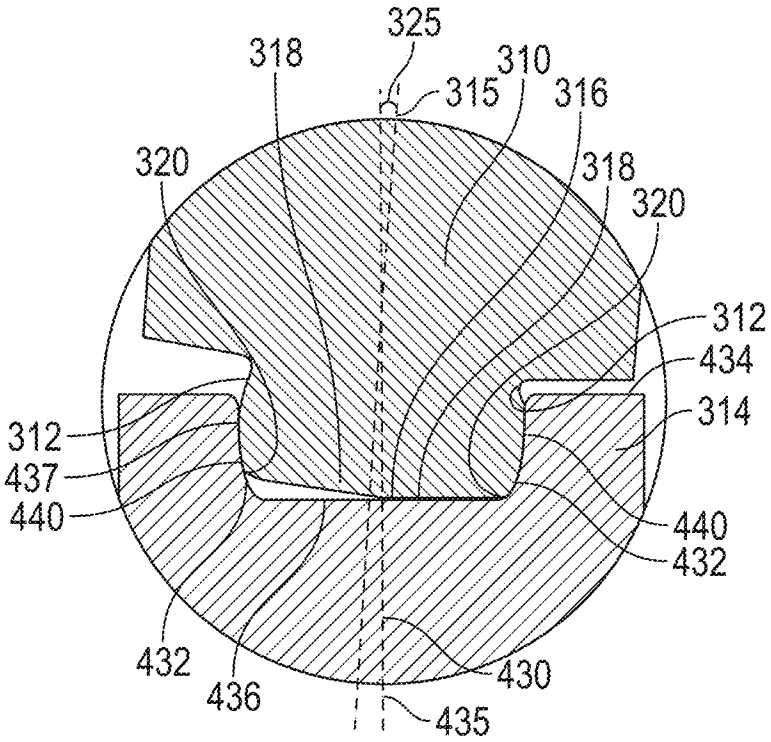
FIGS. 30A, 30B are side cross-sectional views of another embodiment of a slidable drive connector in accordance with principles disclosed herein.
Figure 30A:
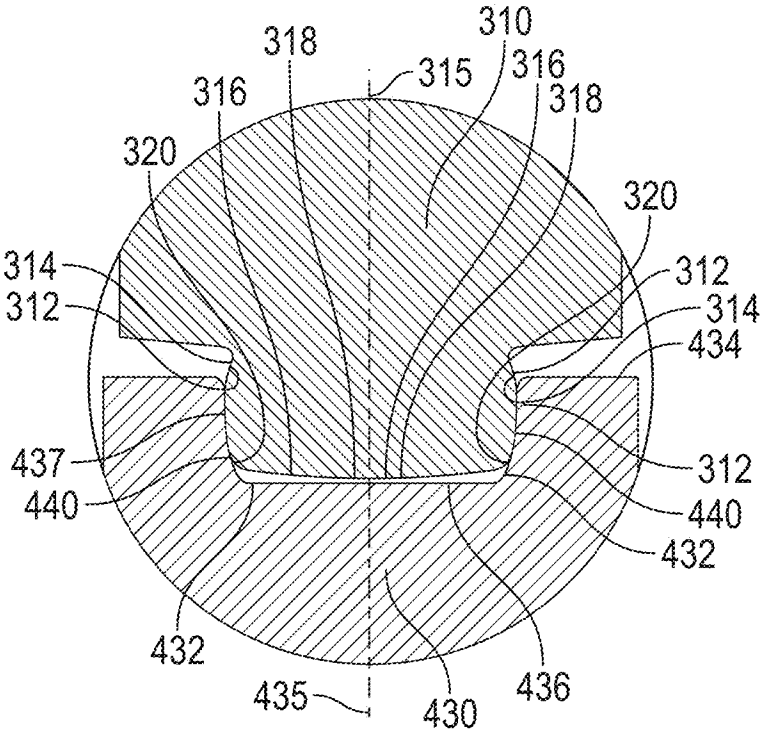

FIGS. 30A-300 illustrate drive key 310 inserted into a drive groove 430 to form a slidable connection that permits the transmission of torque between drive key 310 and drive groove 430. Drive groove 430 may form part of either a rotor or a drive connector in different embodiments. Drive groove 430 has a body central or longitudinal axis 435 and includes a pair of flanking concave bearing surfaces 432 which extend between an upper end face 434 and a terminal end or bottom face 436. Drive groove 430 has a generally rectangular cross-section such that a lateral width of drive groove 430 (the width extending laterally between bearing surfaces 432) at end face 434 is about equal to the lateral width of drive groove 430 at bottom face 436. Given that the bearing surfaces 312 of drive key 310 are convex while the bearing surfaces 432 of drive groove 430 are concave, the maximum lateral width of drive key 310 is greater than the lateral width of drive groove 430 at an upper end or throat 437 of drive groove 430 proximal upper end face 434. Thus, a plug-and-socket arrangement is formed between drive key 310 and drive groove 430 such that relative axial movement is restricted between drive key 310 and drive groove 430 when drive key 310 is inserted into drive groove 430.

In the embodiment of FIGS. 30A-300, the radii of the bearing surfaces 312 of drive key 310 are about equal to the radii of the bearing surfaces 432 of drive groove 430. However, in order to permit a sliding fit between drive key 310 and drive groove 430, the contact area between bearing surfaces 312 and 432 is less than the total surface area of each bearing surface 312 and 432, forming a lateral or radial gap 438 (shown in FIG. 30C) therebetween. In some embodiments, gap 438 may be uniform in width along the interface formed between bearing surfaces 312, 432; however, in other embodiments, the width of gap 438 may vary moving between upper and lower ends of the interface formed between bearing surfaces 312, 432.

Figure 31:
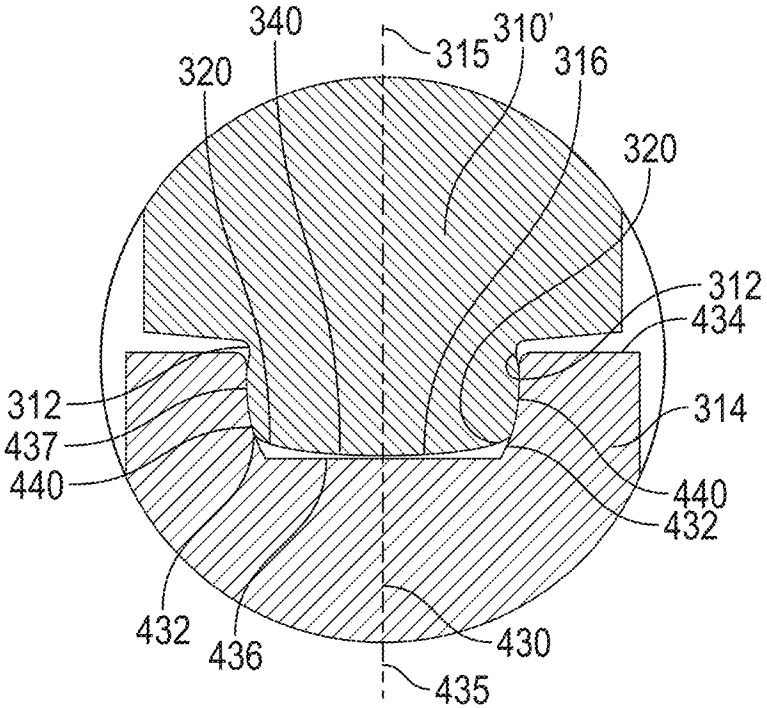
FIG. 31 is a side cross-sectional view of another embodiment of a slidable drive connector in accordance with principles disclosed herein.
Figure 30C:
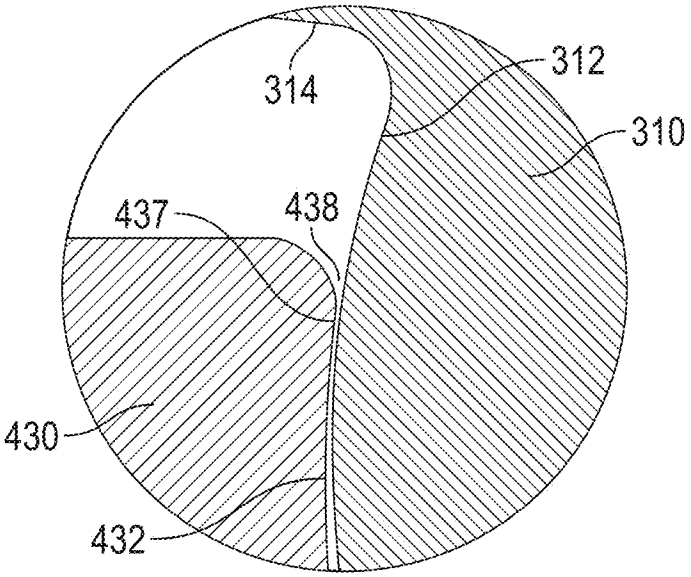
FIG. 30C is a zoomed-in side cross-sectional view of the slidable drive connector of FIGS. 30A, 30B.

In this embodiment, engagement between the bearing surfaces 312 of drive key 310 and the bearing surfaces 432 of drive groove 430 maintain a consistent contact location 440 as drive key 310 pivots between the angularly aligned position and the position of maximum angular misalignment. As shown in FIG. 31, in another embodiment, the drive key 310' comprising crowned surface 340 may be slidably inserted into drive groove 430 to form a slidable connection between drive key 310' and drive groove 430 such that torque may be transferred therebetween.

Figure 32B:
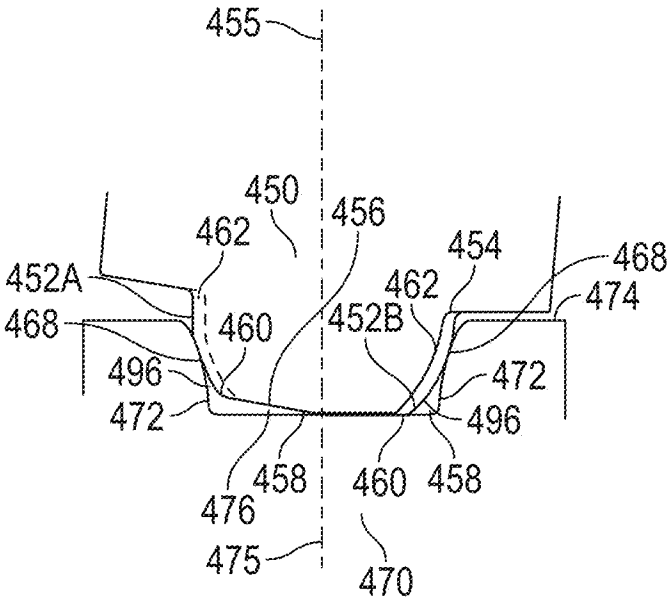
FIG. 32B is a side view of the slidable drive connector of FIG. 32A.
Figure 32A:
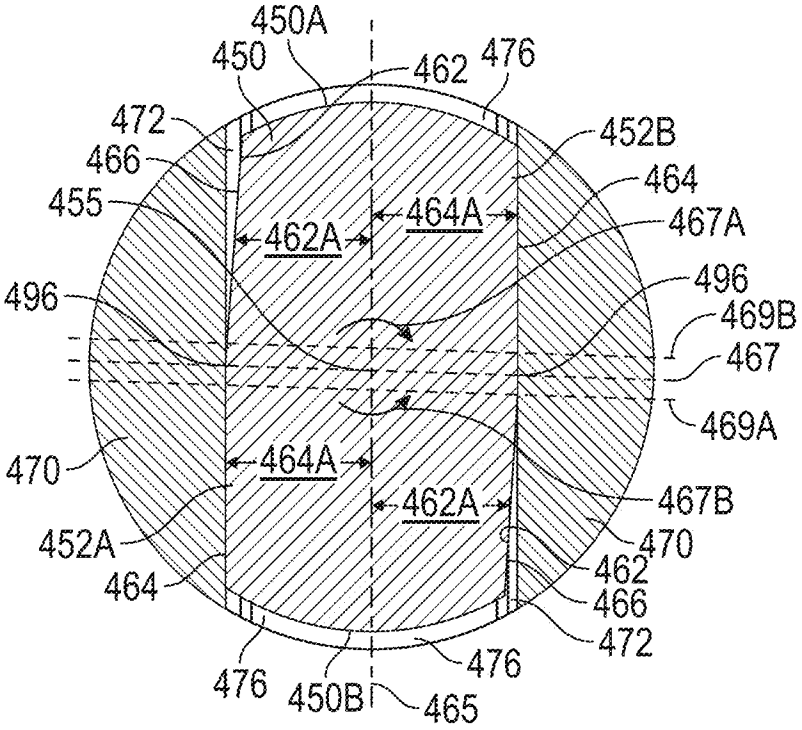
FIG. 32A is a top cross-sectional view of another embodiment of a slidable drive connector in accordance with principles disclosed herein.

FIGS. 32A, 32B illustrate a rounded drive key 450 inserted into a rounded drive groove 470 to form a slidable connection that permits the transmission of torque between drive key 450 and drive groove 470. Drive key 450 may form part of either a rotor or a drive connector in different embodiments, and similarly, drive groove 470 may also form part of either a rotor or a drive connector in different embodiments. Drive key 450 has a body central or longitudinal axis 455 (e.g., the longitudinal axis of the body—rotor, drive connector, etc.—to which drive key 450 is attached) and includes a pair of flanking convex bearings surfaces 452A, 452B that extend between a root 454 of drive key 450 to an end face 456 thereof. End face 456 of drive key 450 is defined by a pair of beveled surfaces 458 (shown in FIG. 32B). A pair of outer edges 460 is formed at the interface between the pair of convex bearing surfaces 452A, 452B and the beveled surfaces 458 defining end face 456. Drive groove 470 has a body central or longitudinal axis 475 (e.g., the longitudinal axis of the body—rotor, drive connector, etc.—in which drive groove 470 is formed) and includes a pair of flanking convex bearing surfaces 472 which extend between an upper end face 474 and a terminal end or bottom face 476.

Figure 33B:
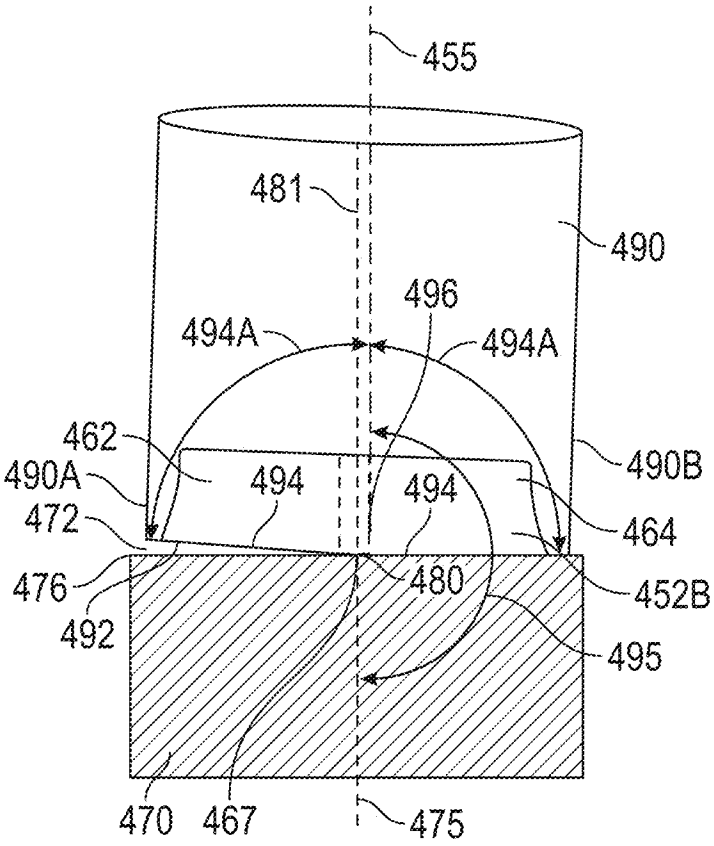
FIG. 33B is a front, partial cross-sectional view of the slidable drive connector of FIG. 33A.
Figure 33A:
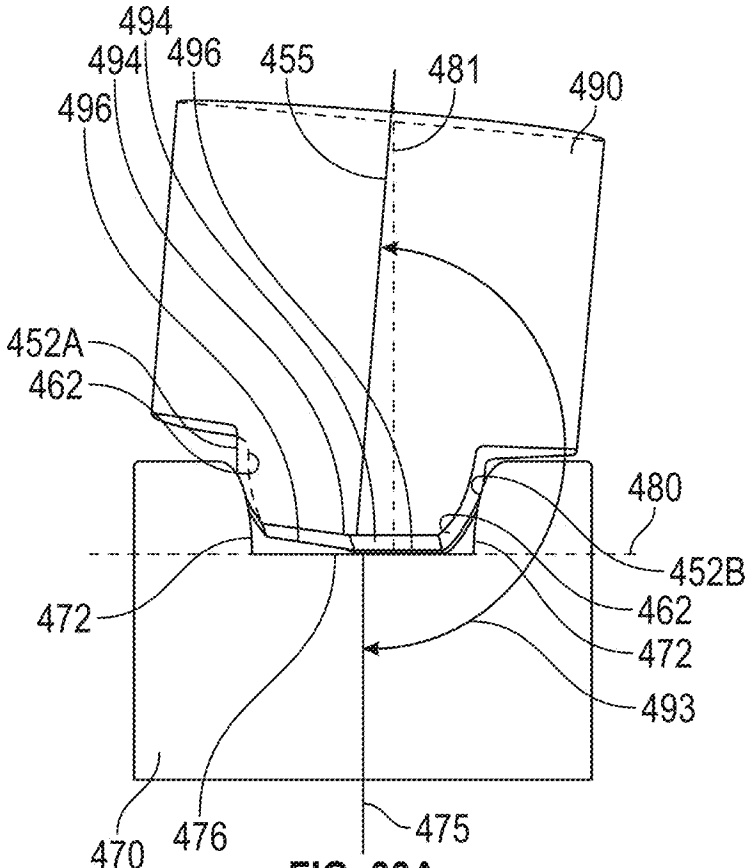
FIG. 33A is a side view of another embodiment of a slidable drive connector in accordance with principles disclosed herein.

Drive key 450 includes a key longitudinal axis or centerline 465 disposed orthogonal body longitudinal axis 455 and extending through longitudinal ends 450A, 450B of drive key 450. Additionally, a median line 467 orthogonal centerline 465 is positioned equidistantly between the longitudinal ends 450A, 450B of drive key 450. Median line 467 is flanked on one side by a parallel but offset first offset axis 469A. Additionally, median line 467 is flanked on the side opposite first offset axis 469A by a parallel but offset second offset axis 469B. First bearing surface 452A includes a first tapered surface 462 extending from second offset axis 469B to first longitudinal end 450A and a second tapered surface 464 extending from first offset axis 469A to the second longitudinal end 450B, and a transition bearing surface 496 between first tapered surface 462 and second tapered surface 464 that extends from first offset axis 469A to second offset axis 469B. Second bearing surface 452B comprises second tapered surface 464 extending from axis 469B to first longitudinal end 450A and first tapered surface 462 extending from axis 469A to the second longitudinal end 450B, and transition bearing surface 496 between first tapered surface 462 and second tapered surface 464 extending from first offset axis 469A to second offset axis 469B. First tapered surface 462 of bearing surfaces 452 comprises a first taper angle 462A relative to centerline 465 while second tapered surface 464 comprises a second taper angle 464A relative to centerline 465. In the embodiment of FIGS. 33A, 33B, first taper angle 452A is about 0°-3.0° and second taper angle 454A is about 0°-3.0°; however, in other embodiments, taper angles 452A, 454A may vary. Tapered bearing surfaces 462, 464 permit limited rotation between drive key 450 and drive groove 470 about body longitudinal axis 450.

Tapered surfaces 462, 464 ensure that at least one tapered surface 462, 464 of each bearing surface 452A, 452B extends substantially parallel with bearing surfaces 472 of drive groove 470. For example, in response to rotation of drive key 450 in a first rotational direction (indicated by arrow 467A in FIG. 32A) about body longitudinal axis 450, second tapered surfaces 464 of bearing surfaces 452A, 452B contact bearing surfaces 472 of drive groove 470, with second tapered surfaces 464 extending substantially parallel to bearing surfaces 472. In response to rotation of drive key 450 in a second rotational direction (indicated by arrow 467B in FIG. 32A) opposite first rotational direction 467A about body longitudinal axis 450, first tapered surfaces 462 of bearing surfaces 452A, 452B contact bearing surfaces 472 of drive groove 470, with first tapered surfaces 462 extending substantially parallel to bearing surfaces 472. Additionally, tapered surfaces 462, 464 form a lateral or radial clearance 466 between each bearing surface 452A, 452B and bearing surfaces 472 of drive groove 470 for cleaning and lubrication between bearing surfaces 452A, 452B of drive key 450 and bearing surfaces 472 of drive groove 470. Further, engagement between the bearing surfaces 452A, 452B of drive key 450 and the bearing surfaces 472 of drive groove 470 maintain a consistent contact location 468 as drive key 450 pivots between an angularly aligned position and a position of maximum angular misalignment (shown in FIG. 32B).

FIGS. 33A, 33B illustrate a rounded drive key 490 inserted into drive groove 470 to form a slidable connection that permits the transmission of torque between drive key 490 and drive groove 470. Drive key 490 may form part of either a rotor or a drive connector in different embodiments. Drive key 490 is similar to drive key 470 shown in FIGS. 32A, 32B except drive key 490 includes a bevel along an end face 492 of drive key 490 that extends between longitudinal ends 490A, 490B of drive key 490. Particularly, the end face 492 of drive key 490 is defined by a pair of beveled bearing surfaces 494, each bevel surface 494 extending from a longitudinal end 490A, 490B, to transition bearing surface 496 positioned between beveled bearing surfaces 494. The intersection of each beveled bearing surface 494, and bevel transition surface 496 form an axis 480, and each transition bevel surface has an orthogonal axis 481. Thus, beveled bearing surfaces 494 each comprise a bevel that is oriented in the direction of the centerline 465 of drive key 490. Transition bearing surface 496 is positioned equidistantly between the longitudinal ends 490A, 490B of drive key 490, with body longitudinal axis 455 extending centrally through transition bearing surface 496. In the embodiment of FIGS. 33A, 33B, the bevel of each beveled bearing surface 494 has a bevel angle 494A, measured between the bevel bearing surface and axis 481, of about 0° to 5°. However, in other embodiments, the bevel angle 494A may vary.

Drive key 490 is pivotable about centerline 465 relative to drive groove 470 between an angularly aligned position and a second position of maximum angular misalignment forming a first maximum misalignment angle 493 (shown in FIG. 33A) between body longitudinal axis 455 of drive key 490 and body longitudinal axis 475. Additionally, drive key 490 is pivotable about median line 467 relative to drive groove 470 between an angularly aligned position and a second position of maximum angular misalignment forming a second maximum misalignment angle 495 (shown in FIG. 33A) between body longitudinal axis 455 of drive key 490 and body longitudinal axis 475. Thus, beveled bearing surfaces 494 of drive key 490 provide an additional degree of freedom to the sliding connection formed between drive key 490 and drive groove 470, which assists with the prevention of binding of drive key 490 and drive groove 470 during operation.

Beveled bearing surfaces 494 of drive key 490 ensure that at least one tapered surface beveled bearing surface 494 extends parallel with the bottom face 476 of drive groove 470. Although in this embodiment the end face 492 of drive key 490 is defined by beveled bearing surfaces 494 and transition bearing surface, in other embodiments, the end face 492 of drive key 492 may include a crowned bearing surface oriented in the direction of centerline 465 to thereby provide pivoting of drive key 490 about median line 467 relative to drive groove 470.

Figure 34:
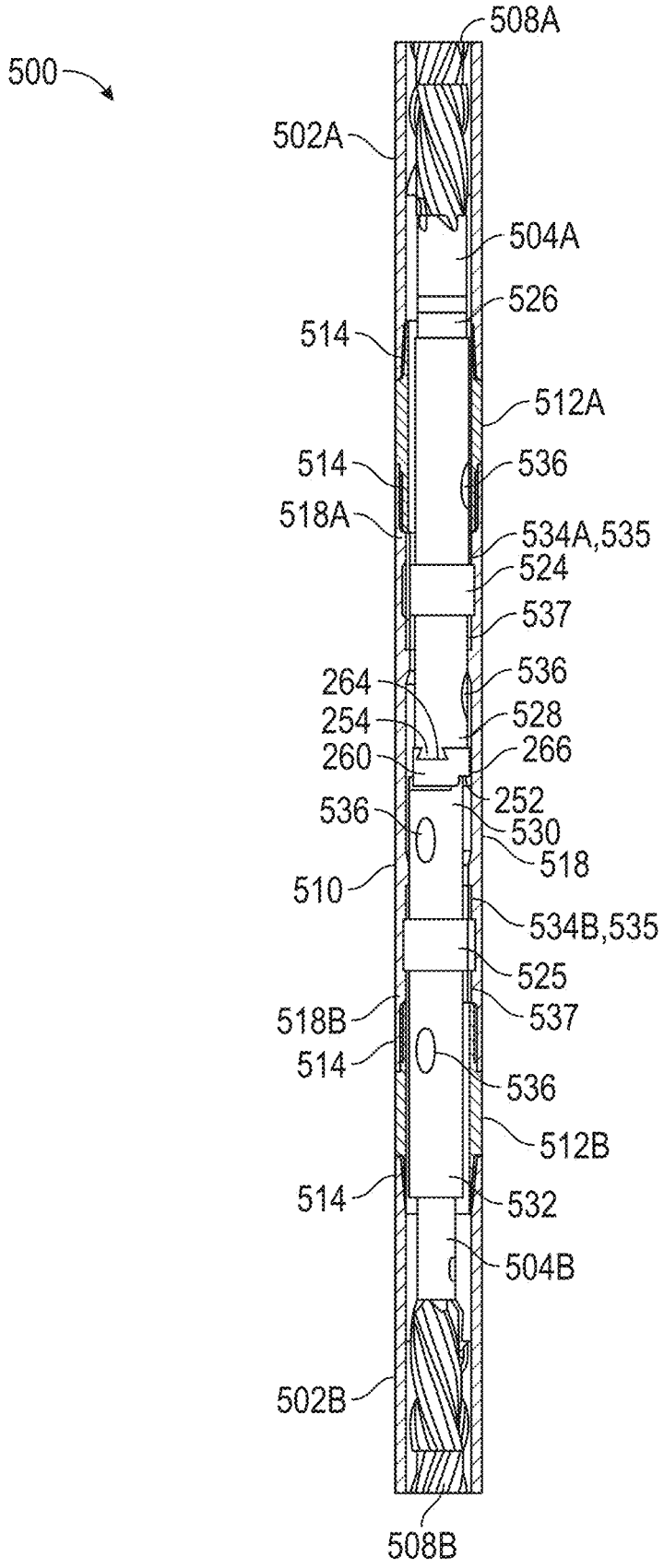
FIG. 34 is a side, partial cross-sectional view of an embodiment of a modular downhole assembly in accordance with principles disclosed herein.

Referring to FIG. 34, an embodiment of a modular downhole assembly 500 is shown. Downhole assembly 500 generally includes a first or upper power section 502A a second or lower power section 502B, and a slidable connector module 510 coupled between upper power section 502A and lower power section 502B. Power sections 502A, 502B each include a rotor 504A, 504B, respectively, rotatably disposed in a stator 508A, 508B, respectively. In the embodiment of FIG. 34, slidable connector module 510 includes a first or upper housing retainer 512A, a second or lower housing retainer 512B, a connector housing 518, a first or upper drive pin or shaft 524, a second or lower drive pin or shaft 525, and slidable drive connector 260.

Upper drive pin 524 includes a first or upper end 526 coupled to rotor 504A of upper power section 502A and a second or lower end 528 comprising drive key 254, which is insertable into drive connector 260 to form a slidable connection between upper drive pin 524 and drive connector 260. Lower drive pin 525 includes a first or upper end 530 and a second or lower end 532 coupled to rotor 504B of lower power section 502B. Upper end 530 of lower drive pin 525 comprises drive key 252 which is insertable into drive connector 260 to form a slidable connection between drive connector 260 and lower drive pin 525. Slidable connector module 510 additionally includes a first or upper bearing assembly 534A comprising bearings 535, 537, and a second or lower bearing assembly 534B comprising bearings 535, 537. Each bearing assembly 534A, 534B includes one or more radial and thrust bearings for absorbing radially and axially directed loads applied to rotors 504A, 504B. In embodiments, the bearings 535, 537 of bearing assemblies 534A, 534B may comprise journal bearings, ball bearings, roller bearings, etc. Upper bearing assembly 534A is positioned radially between upper drive pin 524 and connector housing 518 while lower bearing assembly 534B is positioned radially between lower drive pin 525 and connector housing 518. In this embodiment, drive pins 524, 525 each include a plurality of flow ports or passages 536 that provide additional flow area for fluid flowing through downhole assembly 500.

Stators 508A, 508B, housing retainers 512A, 512B, and connector housing 518 each include releasable or threaded connectors 514 at ends thereof for forming threaded connections between stator 508A of upper power section 502A and upper housing retainer 512A, upper housing retainer 512A and connector housing 518, connector housing 518 and lower housing retainer 512B, and lower housing retainer 512B and stator 508B of lower power section 502B. Thus, the housing retainers 512A, 512B and connector housing 518 of connector module 510 serve to threadably connect the stators 508A, 508B of power sections 502A, 502B, respectively, thereby preventing relative axial and rotational movement between stators 508A, 508B. As described above, drive connector 260 permits transmission of torque between rotor 504A of upper power section 502A and rotor 504B of lower power section 502B while permitting axial misalignment between longitudinal axes of rotors 504A, 504B. Although in this embodiment connector module 510 comprises drive connector 260, in other embodiments, connector module 510 may comprise any other of the drive connectors described herein, including drive connectors having drive keys or grooves that permit pivoting about the centerline and median line of the drive key, such as the drive key 490 shown in FIGS. 33A, 33B. [own] In an embodiment, connector module 510 is assembled by inserting lower bearing 537 of upper bearing assembly 534A into a first or upper end 518A of connector housing 518, followed by upper drive pin 524 with drive connector 260 attached to the lower end 528 thereof. Then upper bearing 535 of upper bearing assembly 534A is inserted into the upper end 518A of connector housing 518. Upper bearing assembly 534A and upper drive pin 524 are then secured within connector housing 518 by threadably coupling upper housing retainer 512A to the upper end 518A of connector housing 518. Upper bearing 535 of lower bearing assembly 534B is then inserted into a second or lower end 518B of connector housing 518, followed by lower drive pin 525.

Lower drive pin 525 is then rotated until the drive key 252 of lower drive pin 525 aligns with and is inserted into the lower drive groove 266 of drive connector 260. Then lower bearing 537 of lower bearing assembly 534B is inserted into the lower end 518B of connector housing 518. Lower bearing assembly 534B and lower drive pin 525 are then secured within connector housing 518 by threadably coupling lower housing retainer 512B to the lower end 518B of connector housing 518. Rotors 504A, 504B may then be coupled to drive pins 524,525, respectively (e.g., via threadable connectors, etc.) followed by the coupling of housing retainers 512A, 512B with stators 508A, 508B, respectively.

In the manner described above, connector module 510 provides a modular and flexible means for conveniently coupling any two power sections together to form a slidable connection therebetween. For example, although the embodiment of FIG. 34 only includes two power sections 502A, 502B and a single connector module 510, in other embodiments, additional connector modules 510 may be added to connect additional power sections as desired in view of the requirements of the given application. Moreover, given that downhole assembly 500 may be assembled in the field (and not at a manufacturing facility), the number of power sections of downhole assembly 500 may be adjusted in view of changing conditions in the field.

Figure 35:
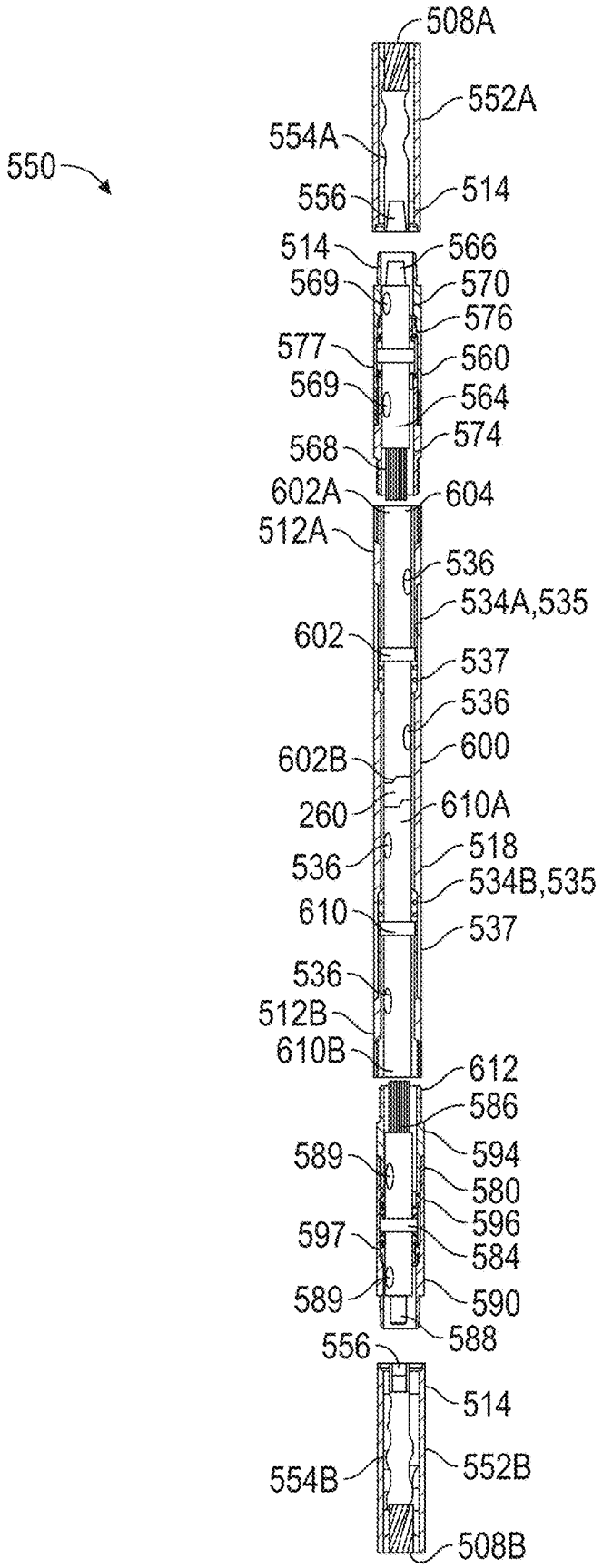
FIG. 35 is a side, partial cross-sectional view of another embodiment of a modular downhole assembly in accordance with principles disclosed herein.

Referring to FIGS. 35-39, another embodiment of a downhole assembly 550 is shown in FIG. 35. Downhole assembly 550 includes features in common with downhole assembly 500 shown in FIG. 34, and shared features are labeled similarly. Downhole assembly 550 generally includes a first or upper power section 552A, a second or lower power section 552B, a first or upper thrust module 560, a second or lower thrust module 580, and a slidable connector module 600 coupled between power sections 552A, 552B. Power sections 552A, 552B each include a rotor 554A, 554B, respectively, rotatably disposed in stator 508A, 508B, respectively. Rotors 554A, 554B are similar to the rotors 504A, 504B shown in FIG. 34 but include threadable connectors 556 for coupling with thrust modules 560, 580.

Figure 36:
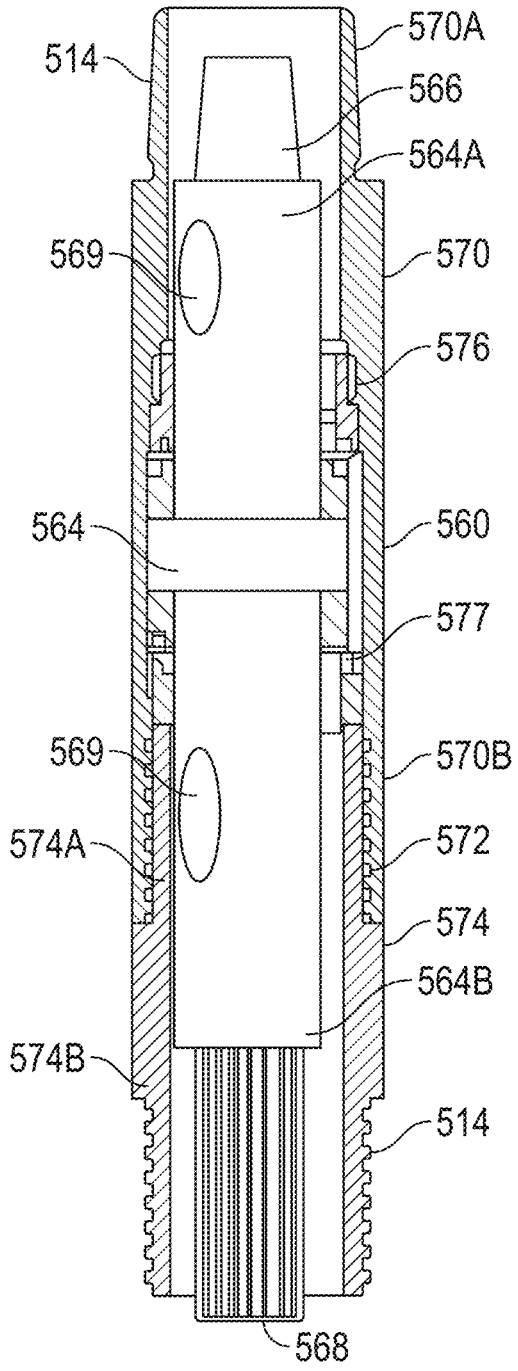
FIG. 36 is a side, partial cross-sectional view of an upper thrust module of the downhole assembly of FIG. 35.

As shown particularly in FIG. 36, upper thrust module 560 includes a thrust bearing shaft 564, an outer bearing housing 570, and a bearing retainer 574. Thrust bearing shaft 564 is rotatably disposed in the bearing housing 570 and bearing retainer 574 and includes a first or upper end 564A comprising a releasable or threaded connector 566 for coupling with the threaded connector 556 of rotor 554A, and a second or lower end 564B comprising an axially slidable connector 568. Additionally, thrust bearing shaft 564 includes a plurality of flow ports or passages 569 that provide additional flow area for fluid flowing through downhole assembly 550. Bearing housing 570 has a first or upper end 570A comprising threaded connector 514 and a second or lower end 570B comprising a threaded connector 572 for coupling bearing housing 570 with bearing retainer 574.

Bearing retainer 574 of upper thrust module 560 includes a first or upper end 574A that couples with bearing housing 570 via threaded connector 572 and a second or lower end 574B that includes threaded connector 514. Additionally, upper thrust module 560 includes a first or upper bearing assembly 576 and a second or lower bearing assembly 577, each of the bearing assemblies 576, 577 being positioned radially between thrust bearing shaft 564 and bearing housing 570. Each bearing assembly 576, 577 includes one or more radial and/or thrust bearings for absorbing radially and axially directed loads applied to thrust bearing shaft 564. In embodiments, the bearings of bearing assemblies 576, 577 may comprise journal bearings, ball bearings, roller bearings, etc. Bearing retainer 574 of upper thrust module 560 retains bearing assemblies 576, 577 within bearing housing 570 following the assembly of upper thrust module 560.

Figure 37:
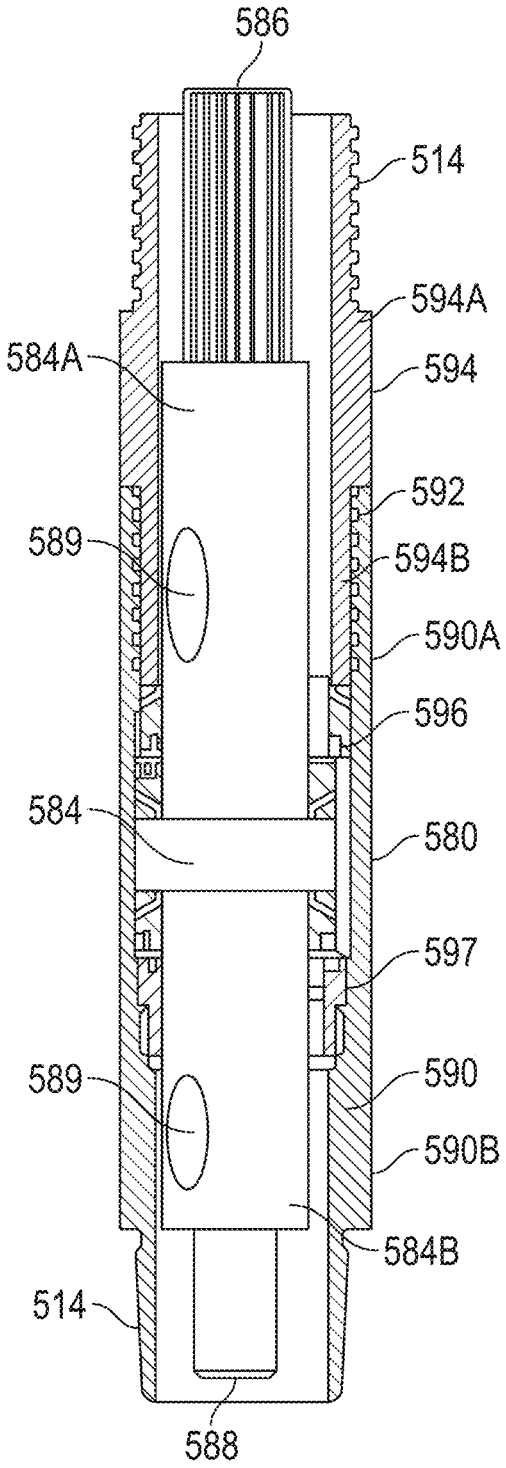
FIG. 37 is a side, partial cross-sectional view of a lower thrust module of the downhole assembly of FIG. 35.

As shown particularly in FIG. 37, lower thrust module 580 includes a thrust bearing shaft 584, an outer bearing housing 590, and a bearing retainer 594. Thrust bearing shaft 584 is rotatably disposed in the bearing housing 590 and bearing retainer 594 and includes a first or upper end 584A comprising an axially slidable connector 586, and a second or lower end 564B comprising a releasable or threaded connector 588 for coupling with the threaded connector 556 of rotor 554B. Additionally, thrust bearing shaft 584 includes a plurality of flow ports or passages 589 that provide additional flow area for fluid flowing through downhole assembly 550. Bearing housing 590 has a first or upper end 590A a threaded connector 592 for coupling bearing housing 590 with bearing retainer 594, and a second or lower end 590B comprising threaded connector 514.

Bearing retainer 594 of lower thrust module 580 includes a first or upper end 594A that includes threaded connector 514, and a second or lower end 594B that couples with bearing housing 590 via threaded connector 592. Additionally, lower thrust module 580 includes a first or upper bearing assembly 596 and a second or lower bearing assembly 597, each of the bearing assemblies 596, 597 being positioned radially between thrust bearing shaft 584 and bearing housing 590. Each bearing assembly 596, 597 includes one or more radial and/or thrust bearings for absorbing radially and axially directed loads applied to thrust bearing shaft 584. In embodiments, the bearings of bearing assemblies 596, 597 may comprise journal bearings, ball bearings, roller bearings, etc. Bearing retainer 594 of lower thrust module 580 retains bearing assemblies 596, 597 within bearing housing 590 following the assembly of lower thrust module 580.

Slidable connector module 600 of downhole assembly 550 generally includes upper housing retainer 512A, lower housing retainer 512B, connector housing 518, a first or upper drive pin or shaft 602, a second or lower drive pin or shaft 610, and slidable drive connector 260. Upper drive pin 602 includes a first or upper end 602A and a second or lower end 602B. Upper drive pin 602 is similar to the upper drive pin 524 shown in FIG. 34 except that the upper end 602A of upper drive pin 602 comprises an axially slidable connector 604. Lower drive pin 610 includes a first or upper end 610A and a second or lower end 610B. Lower drive pin 610 is similar to the lower drive pin 525 shown in FIG. 34 except that the lower end 610B of lower drive pin 610 comprises an axially slidable connector 612.

Figure 38:
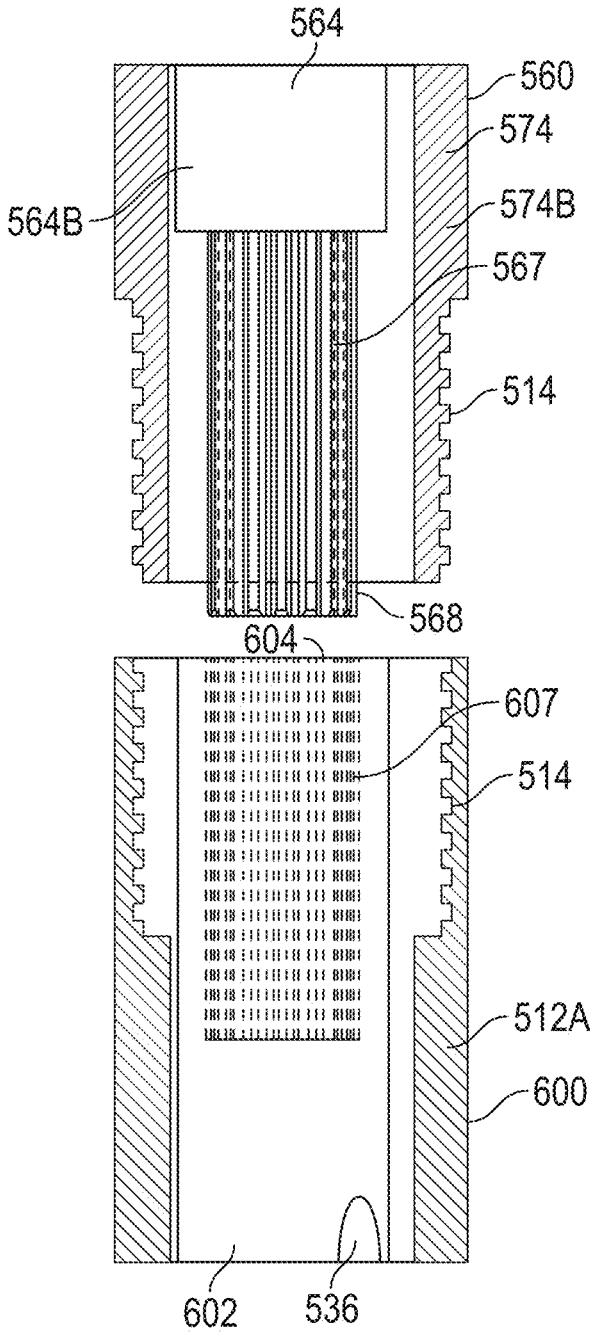
FIG. 38 is a side cross-sectional view of the upper thrust module and a slidable connector module of the downhole assembly of FIG. 35.

As shown particularly in FIG. 38, lower end 574B of the bearing retainer 574 of upper thrust module 560 may be threadably connected to upper housing retainer 512A via threaded connector 514. Additionally, axially slidable connector 568 of the thrust bearing shaft 564 of upper thrust module 560 may be slidably coupled with the axially slidable connector 604 of the upper drive pin 602 of connector module 600 to permit torque to be transferred between thrust bearing shaft 564 and upper drive pin 602 while permitting relative axial movement therebetween. In the embodiment of FIGS. 35-39, the axially slidable connector 568 of thrust bearing shaft 564 comprises a plurality of circumferentially spaced splines 567 which are insertable into a plurality of circumferentially spaced slots 607 of which the axially slidable connector 604 of upper drive pin 602 is comprised; however, in other embodiments, other mechanisms may be utilized for transferring torque between thrust bearing shaft 564 and upper drive pin 602 while permitting relative axial movement therebetween.

Figure 39:
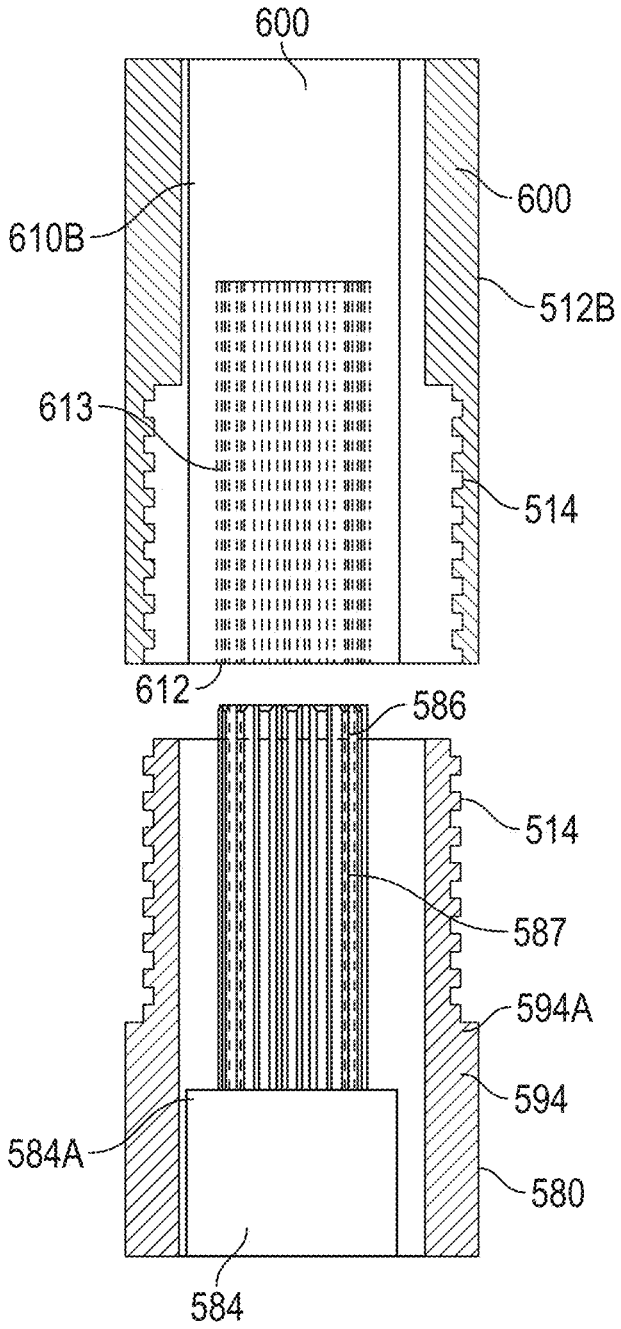
FIG. 39 is a side cross-sectional view of the lower thrust module and a slidable connector module of the downhole assembly of FIG. 35.

As shown particularly in FIG. 39, the lower housing retainer 512B of connector module 600 may be threadably connected to upper end 594A of the bearing retainer 594 of lower thrust module 580 via threaded connector 514. Additionally, axially slidable connector 612 of the lower drive pin 610 of connector module 600 may be slidably coupled with axially slidable connector 586 of the thrust bearing shaft 584 of lower thrust module 580 to permit torque to be transferred between thrust bearing shaft 584 and lower drive pin 610 while permitting relative axial movement therebetween. In the embodiment of FIGS. 35-39, the axially slidable connector 586 of thrust bearing shaft 584 comprises a plurality of circumferentially spaced splines 587 which are insertable into a plurality of circumferentially spaced slots 613 of which the axially slidable connector 612 of lower drive pin 610 is comprised; however, in other embodiments, other mechanisms may be utilized for transferring torque between thrust bearing shaft 584 and lower drive pin 610 while permitting relative axial movement therebetween.

The thrust modules 560, 580 of downhole assembly 550 receive thrust loads imparted from rotors 554A, 554B, thereby reducing and minimizing the amount of thrust loads imparted to drive connector 260 (positioned between thrust modules 560, 580) during the operation of downhole assembly 550. By reducing the thrust load received by drive connector 260 from rotors 554A, 554B, the amount of friction and ware on drive connector 260 may be reduced and minimized, thereby extending the operational life of drive connector 260. Further, the threadable connection formed between the thrust bearing shaft 584 of lower thrust module 580 and rotor 554B provides control over the axial location of rotor 554B, thereby providing a backup mechanism for retaining rotor 554B (as well as components coupled to the lower end of rotor 554B) in the event that a primary retention mechanism of the downhole assembly 550 fails.

Figure 40:
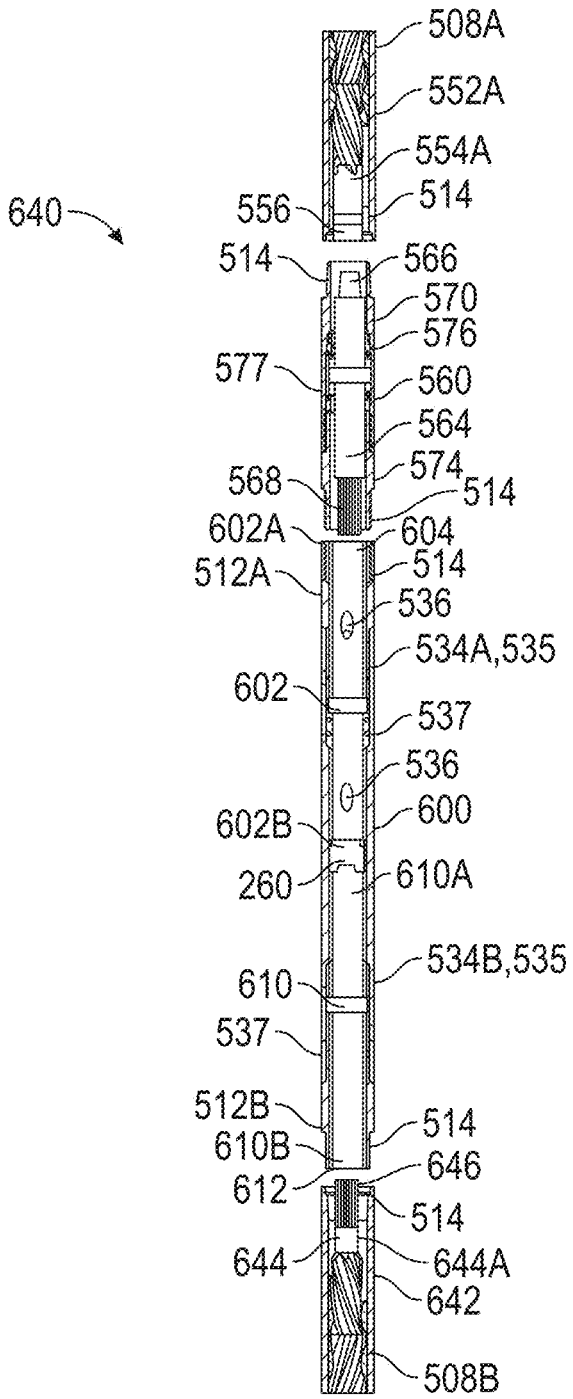
FIG. 40 is a side, partial cross-sectional view of another embodiment of a modular downhole assembly in accordance with principles disclosed herein.
Figure 41:
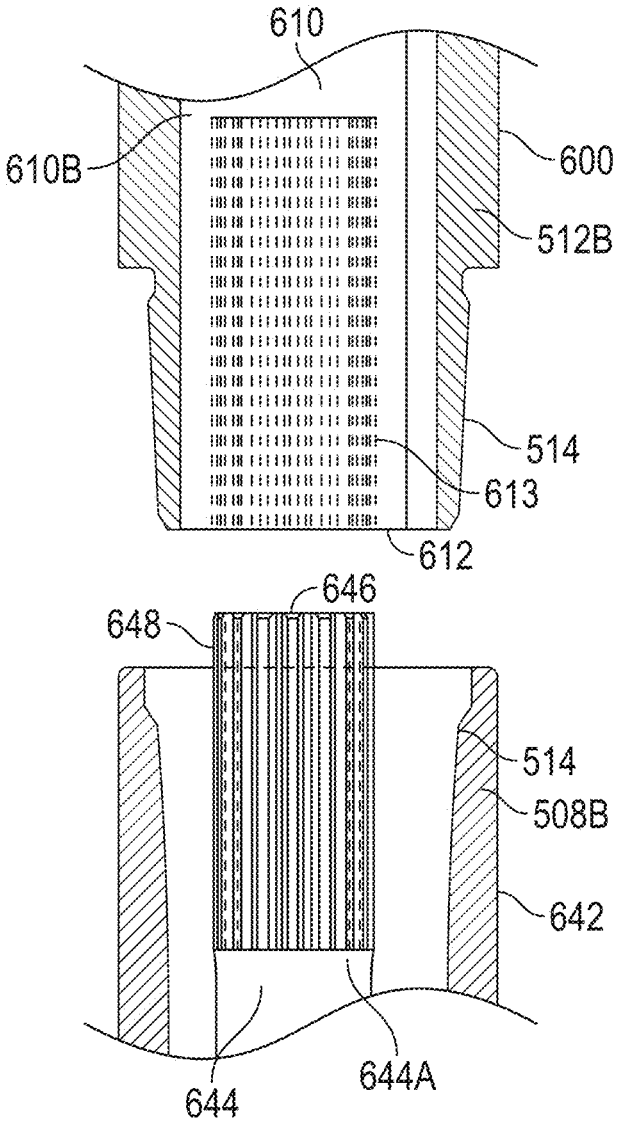
FIG. 41 is a side cross-sectional view of a lower thrust module and a lower power section of the downhole assembly of FIG. 40.
Figure 42:
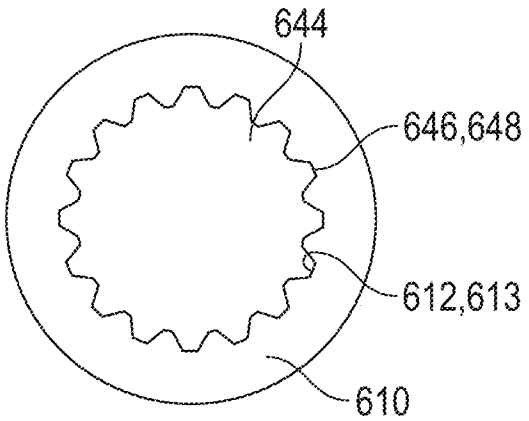
FIG. 42 is a top cross-sectional view of a pair of mating axially slidable connectors of the downhole assembly of FIG. 40.

Referring to FIGS. 40-42, another embodiment of a downhole assembly 640 is shown in FIG. 40. Downhole assembly 640 includes features in common with downhole assembly 500 shown in FIG. 34 and downhole assembly 550 shown in FIGS. 35-39, and shared features are labeled similarly. Downhole assembly 640 generally includes upper power section 552A, a second or lower power section 642, upper thrust module 560, and slidable connector module 600 coupled between power sections upper thrust module 560 and the lower power section 642. Lower power section 642 comprises a rotor 644 rotatably disposed in stator 508B. A first or upper end 644A of rotor 644 comprises an axially slidable connector 646.

As shown particularly in FIG. 41, in the embodiment of FIGS. 40-42, the axially slidable connector 646 of rotor 644 comprises a plurality of circumferentially spaced splines 648 which are insertable into the plurality of circumferentially spaced slots 613 of lower drive pin 610; however, in other embodiments, other mechanisms may be utilized for transferring torque between rotor 644 and lower drive pin 610 while permitting relative axial movement therebetween. Unlike the downhole assembly 550 shown in FIG. 35, downhole assembly 640 does not include a thrust module positioned between connector module 600 and lower power section 642. Thus, in this embodiment, relative axial movement is permitted between the rotor 644 of lower power section 642 and the lower drive pin 610 of connector module 600, which may be beneficial in applications where it is desired to axially displace rotor 644.

Figure 43:
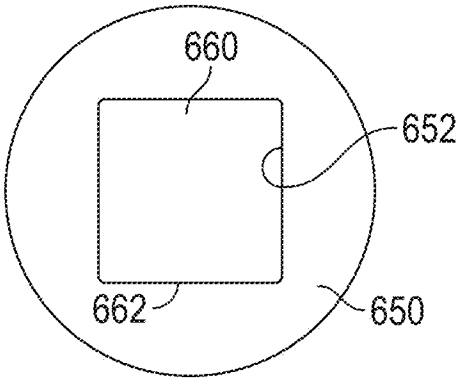
FIG. 43 is a top cross-sectional view of another embodiment of a pair of mating axially slidable connectors in accordance with principles disclosed herein.
Figure 44:
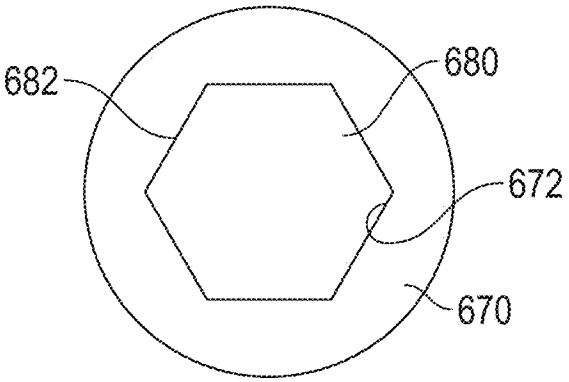
FIG. 44 is a top cross-sectional view of another embodiment of a pair of mating axially slidable connectors in accordance with principles disclosed herein.
Figure 45:
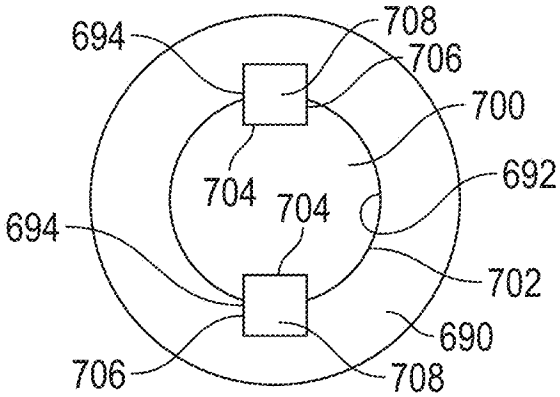
FIG. 45 is a top cross-sectional view of another embodiment of a pair of mating axially slidable connectors in accordance with principles disclosed herein.

Referring to FIGS. 43-45, additional embodiments of axially slidable connectors for downhole assemblies, such as downhole assemblies 500, 550, and 640 are shown. The axially slidable connectors shown in FIGS. 43-45 illustrate alternative mechanisms for providing an axially slidable connection through which torque may be transmitted. FIG. 43 illustrates an outer cylindrical body or housing 650 and an inner cylindrical body or shaft 660. Housing 650 includes a central passage defined by a generally rectangular inner surface 652. Shaft 660 has a generally rectangular outer surface 662 that matingly engages the rectangular inner surface 652 of housing 650 to permit relative axial movement between housing 650 and shaft 660 while still providing for the transmission of torque therebetween.

FIG. 44 illustrates an outer cylindrical body or housing 670 and an inner cylindrical body or shaft 680. Housing 670 includes a central passage defined by a generally hexagonal surface 672. Shaft 680 has a generally hexagonal outer surface 682 that matingly engages the hexagonal inner surface 672 of housing 670 to permit relative axial movement between housing 670 and shaft 680 while still providing for the transmission of torque therebetween.

FIG. 45 illustrates an outer cylindrical body or housing 690, an inner cylindrical body or shaft 700, and a plurality of circumferentially spaced elongate keys 708 positioned radially between housing 690 and shaft 700. Housing 690 includes a central passage defined by a generally cylindrical inner surface 692, inner surface 692 including a plurality of circumferentially spaced grooves or slots 694 formed therein. Shaft 700 includes a generally cylindrical outer surface 702 including a plurality of circumferentially spaced grooves or slots 704 formed therein. Slots 694 of housing 690 may be angularly or circumferentially aligned with slots 704 of shaft 700 to form a pair of pockets 706 each receiving a key 708 to restrict relative rotation between housing 690 and shaft 700. Thus, when keys 708 are received in pockets 706, torque may be transmitted between housing 690 and shaft 700 while permitting relative axial movement therebetween.

Figure 46:
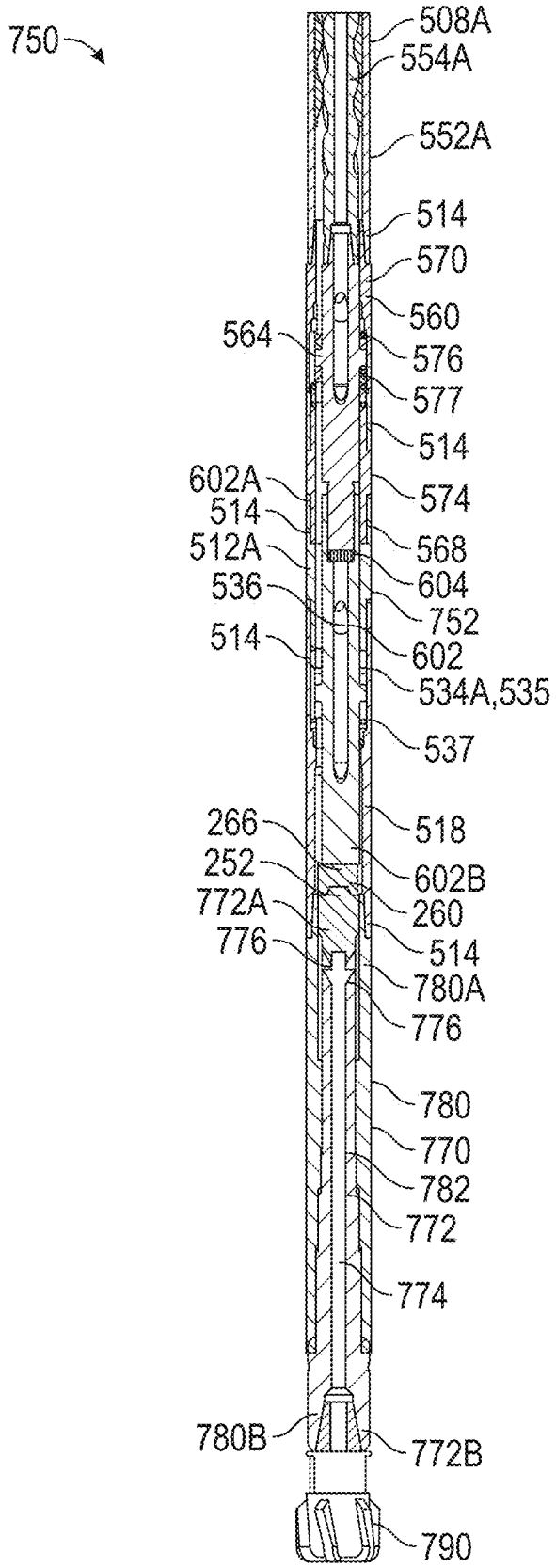
FIG. 46 is a side cross-sectional view of another embodiment of a modular downhole assembly in accordance with principles disclosed herein.

Referring to FIG. 46, another embodiment of a downhole assembly 750 is shown in FIG. 46. Downhole assembly 750 includes features in common with downhole assembly 500 shown in FIG. 34, downhole assembly 550 shown in FIGS. 35-39, and downhole assembly 640 shown in FIGS. 40-42, and shared features are labeled similarly. Downhole assembly 750 generally includes upper power section 552A, upper thrust module 560, a slidable connector module 752, a bearing assembly 770, and a drill bit 790. Connector module 752 of downhole assembly 750 is similar to the slidable connector module 600 shown in FIG. 35 but does not include lower housing retainer 512B and lower drive pin 610.

The bearing assembly 770 of downhole assembly 750 includes a bearing mandrel 772 rotatably disposed in a bearing housing 780. Bearing mandrel 772 has a first or upper end 772A, a second or lower end 772B, and a central passage 774 extending between ends 772A, 772B. The upper end 772A of bearing mandrel 772 comprises upper drive key 252 which is insertable into lower drive groove 266 of the drive connector 260 of connector module 752, forming a slidable connection between the upper drive pin 602 of connector module 752 and bearing mandrel 772. The lower end 772B of bearing mandrel 772 is coupled to drill bit 790. Bearing housing 780 of bearing assembly 770 has a first or upper end 780A and a second or lower end 780B. Upper end 780A comprises a threaded connector 514 for threadably connecting bearing housing 780 with the connector housing 518 of connector module 752.

A bearing assembly 782 is positioned radially between the bearing mandrel 772 and bearing housing 780 of bearing assembly 770. Bearing assembly 782 includes radial and thrust bearings for supporting rotation of bearing mandrel 772 and absorbing axially directed thrust loads applied to bearing mandrel 772. During operation of downhole assembly 750, pressurized drilling fluid flowing through power section 552A enters the central passage 774 of bearing mandrel 772 via radial ports 776 formed in bearing mandrel 772. The pressurized drilling fluid then flows through central passage 774 of bearing mandrel 772 and is supplied to drill bit 790, from where the drilling fluid is ejected via one or more fluid jets of drill bit 790. The drive connector 260 of connector module 752 permits misalignment or offset between bearing mandrel 772 and the rotor 554A of power section 552A while permitting transmission of torque therebetween. Thus, in this embodiment, power section 552A comprises a downhole drilling motor for rotating drill bit 790 during the operation of downhole assembly 750. Although in the embodiment of FIG. 46 drive connector 260 is coupled between upper drive pin 602 and bearing mandrel 772, in other embodiments, other various drive connectors described herein may be coupled between upper drive pin 602 and bearing mandrel 772. Although in this embodiment downhole assembly 750 includes upper thrust module 560, in other embodiments, downhole assembly 750 may not include a thrust module, and instead, rotor 554A of power section 552A may be directly connected with bearing mandrel 772. In such embodiments, the bearing mandrel 772 may comprise two separate bearing mandrels slidably connected together via a slidable drive connector. In other embodiments, a thrust module may be connected between the separate bearing mandrels of the bearing assembly.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A progressing cavity device, comprising:

a stator having a fixed longitudinal axis and comprising a first end, a second end, and an inner surface formed from a metallic material that extends between the first end and the second end;

a rotor rotatably disposed in the stator whereby a longitudinal axis of the rotor is permitted to rotate eccentrically relative to the fixed longitudinal axis of the stator, the rotor comprising a first end, a second end, and an outer surface formed from a metallic material that extends between the first end and the second end, wherein the outer surface of the rotor contacts the inner surface of the stator; and a thrust bearing positioned at at least one of the first end and the second end of the rotor and which resists axially directed loads applied to the rotor and to define a position of the rotor along the longitudinal axis of the stator, wherein the thrust bearing comprises a contact surface in contact with the rotor and which is axially adjustable to position the rotor between one of a plurality of separate axial positions spaced along the longitudinal axis of the stator;

wherein the inner surface of the stator comprises a conical taper extending between the first end and the second end;

wherein the outer surface of the rotor comprises a conical taper extending between the first end and the second end.

2. The progressing cavity device of claim 1, wherein the taper of the inner surface of the stator and the taper of the outer surface of the rotor each comprise a fixed taper angle.

3. The progressing cavity device of claim 1, wherein the outer surface of the rotor is a helical surface comprising a plurality of rotor lobes and the inner surface of the stator is a helical surface comprising a plurality of stator lobes configured to intermesh with the rotor lobes.

4. The progressing cavity device of claim 1, wherein the first end of the stator comprises a fluid inlet end and the second end of the stator comprises a fluid outlet end, and wherein a diameter of the inner surface of the stator is greater at the second end than at the first end of the stator.

5. The progressing cavity device of claim 1, wherein:

the rotor comprises a first position in the stator providing a first clearance between the outer surface of the rotor and the inner surface of the stator; and the rotor comprises a second position that is axially spaced from the first position and provides a second clearance between the outer surface of the rotor and the inner surface of the stator that is greater than the first clearance.

6. The progressing cavity device of claim 1, wherein the thrust bearing has a first configuration positioning the rotor at a first position along the longitudinal axis of the stator and a second configuration positioning the rotor at a second position along the longitudinal axis of the stator that is spaced from the first position.

7. The progressing cavity device of claim 6, wherein the first configuration of the thrust bearing corresponds to a first position of the contact surface along the longitudinal axis of the stator, and the second configuration of the thrust bearing corresponds to a second position of the contact surface along the longitudinal axis of the stator that is spaced from the first position of the contact surface.

8. The progressing cavity device of claim 1, wherein the thrust bearing comprises one or more shims receivable in the stator to adjust the position of the rotor along the longitudinal axis of the stator.

* * * * *